US008485792B2

(12) United States Patent
McCourt et al.

(10) Patent No.: US 8,485,792 B2
(45) Date of Patent: Jul. 16, 2013

(54) METHOD FOR INCREASING COMPRESSED AIR EFFICIENCY IN A PUMP

(75) Inventors: Mark D. McCourt, Rittman, OH (US); Haihong Zhu, Marietta, GA (US); Michael Brace Orndorff, Douglasville, GA (US); Jevawn Sebastian Roberts, Atlanta, GA (US); Charles Randolph Abbott, Marietta, GA (US)

(73) Assignee: Warren Rupp, Inc., Mansfield, OH (US)

( * ) Notice: Subject to any disclaimer, the term of this patent is extended or adjusted under 35 U.S.C. 154(b) by 576 days.

(21) Appl. No.: 12/693,044

(22) Filed: Jan. 25, 2010

(65) Prior Publication Data

US 2010/0189577 A1 Jul. 29, 2010

Related U.S. Application Data

(60) Provisional application No. 61/146,959, filed on Jan. 23, 2009.

(51) Int. Cl.
*F04B 49/22* (2006.01)

(52) U.S. Cl.
USPC ..... 417/53; 417/63; 417/393; 417/395; 417/413.1

(58) Field of Classification Search
USPC ..... 417/53, 63, 46, 395, 415, 413.1, 417/417, 293
See application file for complete search history.

(56) References Cited

U.S. PATENT DOCUMENTS

| | | | |
|---|---|---|---|
| 3,741,689 | A | 6/1973 | Rupp |
| 3,838,946 | A | 10/1974 | Schall |
| 3,860,034 | A | 1/1975 | Rupp |
| 4,381,180 | A | 4/1983 | Sell |
| 4,475,665 | A | 10/1984 | Norton |
| 4,478,560 | A | 10/1984 | Rupp |
| 4,549,467 | A | 10/1985 | Wilden et al. |
| 4,856,969 | A | 8/1989 | Forsythe et al. |
| 4,966,528 | A | 10/1990 | Henkel et al. |
| 5,174,731 | A | 12/1992 | Korver |
| 5,252,041 | A | 10/1993 | Schumack |

(Continued)

FOREIGN PATENT DOCUMENTS

WO PCTUS2005041512 5/2006

OTHER PUBLICATIONS

International Search Report, Aug. 26, 2010, 3 pages.
Written Opinion, Aug. 26, 2010, 5 pages.

(Continued)

*Primary Examiner* — Peter J Bertheaud
*Assistant Examiner* — Dominick L Plakkoottam
(74) *Attorney, Agent, or Firm* — Brouse McDowell; Heather M. Barnes; Michael G. Craig

(57) ABSTRACT

A method for increasing compressed air efficiency in a pump utilizes an air efficiency device in order to optimize the amount of a compressed air in a pump. The air efficiency device may allow for controlling the operation of the air operated diaphragm pump by reducing the flow of compressed air supplied to the pump as the pump moves between first and second diaphragm positions. A sensor may be used to monitor velocity of the diaphragm assemblies. In turn, full position feedback is possible so that the pump self adjusts to determine the optimum, or close to optimum, turndown point of the diaphragm assemblies. As such, air savings is achieved by minimizing the amount of required compressed air.

21 Claims, 9 Drawing Sheets

U.S. PATENT DOCUMENTS

| | | | | |
|---|---|---|---|---|
| 5,257,914 | A * | 11/1993 | Reynolds | 417/293 |
| 5,326,234 | A | 7/1994 | Versaw et al. | |
| 5,332,372 | A | 7/1994 | Reynolds | |
| 5,334,003 | A | 8/1994 | Gardner et al. | |
| 5,567,477 | A | 10/1996 | Snyder, Jr. | |
| 5,620,746 | A | 4/1997 | Snyder, Jr. | |
| 5,816,778 | A | 10/1998 | Elsey, Jr. et al. | |
| 5,839,883 | A | 11/1998 | Schmidt et al. | |
| 5,996,627 | A | 12/1999 | Reynolds | |
| 6,036,445 | A | 3/2000 | Reynolds | |
| 6,099,264 | A | 8/2000 | Du | |
| 6,126,403 | A | 10/2000 | Yamada | |
| 6,129,525 | A | 10/2000 | Reynolds | |
| 6,132,176 | A | 10/2000 | Higgins | |
| 6,168,387 | B1 | 1/2001 | Able et al. | |
| 6,241,487 | B1 | 6/2001 | Reynolds | |
| 6,273,686 | B1 | 8/2001 | Kroell et al. | |
| 6,280,149 | B1 * | 8/2001 | Able et al. | 417/63 |
| 6,554,578 | B1 * | 4/2003 | Siegel | 417/53 |
| RE38,239 | E | 8/2003 | Duncan | |
| 6,874,997 | B2 | 4/2005 | Watanabe et al. | |
| 7,021,909 | B1 | 4/2006 | Steck | |
| 7,360,999 | B2 | 4/2008 | Nelson et al. | |
| 7,517,199 | B2 | 4/2009 | Reed et al. | |
| 7,658,598 | B2 | 2/2010 | Reed et al. | |
| 2006/0104829 | A1 | 5/2006 | Reed et al. | |
| 2006/0159565 | A1 | 7/2006 | Sanwald | |
| 2007/0092386 | A1 | 4/2007 | Reed et al. | |
| 2007/0126416 | A1 | 6/2007 | Zhu et al. | |
| 2007/0248474 | A1 * | 10/2007 | Dietzsch et al. | 417/395 |

OTHER PUBLICATIONS

International Preliminary Report on Patentability, Jan. 25, 2011, 6 pages.

* cited by examiner

METHOD FOR INCREASING COMPRESSED AIR EFFICIENCY IN A PUMP

I. BACKGROUND

A. Field of Invention

This invention pertains to the art of methods and apparatuses regarding air operated double diaphragm pumps and more specifically to methods and apparatuses regarding the efficient control and operation of air operated pumps, including without limitation, air operated double diaphragm pumps.

B. Description of the Related Art

Fluid-operated pumps, such as diaphragm pumps, are widely used particularly for pumping liquids, solutions, viscous materials, slurries, suspensions or flowable solids. Double diaphragm pumps are well known for their utility in pumping viscous or solids-laden liquids, as well as for pumping plain water or other liquids, and high or low viscosity solutions based on such liquids. Accordingly, such double diaphragm pumps have found extensive use in pumping out sumps, shafts, and pits, and generally in handling a great variety of slurries, sludges, and waste-laden liquids. Fluid driven diaphragm pumps offer certain further advantages in convenience, effectiveness, portability, and safety. Double diaphragm pumps are rugged and compact and, to gain maximum flexibility, are often served by a single intake line and deliver liquid through a short manifold to a single discharge line.

Although known diaphragm pumps work well for their intended purpose, several disadvantages exist. Air operated double diaphragm (AODD) pumps are very inefficient when compared to motor driven pumps. This is due, in large part, to the compressibility of air used to drive the pump and the inefficiency of compressed air systems. AODD pumps normally operate in the 3-5% efficiency range, while centrifugal and other rotary pumps normally operate in the 50-75% efficiency range. Additionally, conventional double diaphragm pumps do not allow the user to retrieve pump performance information for use in controlling the pumping process.

U.S. Pat. No. 5,332,372 to Reynolds teaches a control system for an air operated diaphragm pump. The control system utilizes sensors to monitor pump speed and pump position and then controls the supply of compressed air to the pump in response thereto. Because pump speed and pump position are effected by pumped fluid characteristics, the control unit is able to change the pump speed or the cycle pattern of the pump assembly in response to changes in pumped fluid characteristics to achieve desired pump operating characteristics. The sensors provide a constant feedback that allows the control system to immediately adjust the supply of compressed air to the pump in response to changes in pump operating conditions without interrupting pump operation. Position sensors may be used to detect pump position. For example, the sensors can comprise a digitally encoded piston shaft operatively connected to the diaphragm assembly that provides a precise signal corresponding to pump position that can be used to detect changes in pump speed and pump position. Flow condition sensors can be utilized to determine flow rate, leakage, or slurry concentration. The sensors transmit signals to a microprocessor that utilizes the transmitted signals to selectively actuate the pump's control valves. By sensing changes in pump position, the control system can control the supply of compressed air to the pump by modifying the settings of the control valves thereby controlling both pump speed and pump cycle pattern at any point along the pump stroke. Digital modulating valves can be utilized to increase the degree of system control provided by the control system. The desired optimal pump conditions can be programmed into the control system and, utilizing information transmitted by the sensors, the control system can experiment with different stroke lengths, stroke speeds, and onset of pumping cycle to determine the optimal pump actuation sequence to achieve and maintain the desired predetermined pumping conditions.

U.S. Pat. No. 5,257,914 to Reynolds teaches an electronic control interface for a fluid powered diaphragm pump. Further, the '372 patent is incorporated into the '914 patent by reference. The supply of compressed air is controlled for the purpose of allowing changes in pump speed or a cycle pattern. This is accomplished by detecting the position and acceleration of the diaphragms. More specifically, the pump utilizes sensors to detect certain pump characteristics, such as pump speed, flow rate, and pump position, but not limited thereto, and sends those signals to the control unit. Because the position and rate of movement of the diaphragm is effected by pumped fluid characteristics, the control unit is able to change the pump speed or cycle pattern of the pump assembly in response to changes in pumped fluid characteristics. The control unit determines elapsed time between pulse signals, which leads to calculations for the speed of reciprocation of the rod and the diaphragms. The control unit, utilizing the changes in the speed of travel of the diaphragms, calculates acceleration and other speed-dependent characteristics of the pump.

U.S. Patent Publication No. 2006/0104829 to Reed et al. discloses a control system for operating and controlling an air operated diaphragm pump. Reed does not use position or acceleration of the diaphragms, but is dependent upon other considerations such as a predetermined time period.

What is needed then is an air operated diaphragm pump that utilizes a self learning process by velocity detection at a floating point or a set point to minimize the amount of compressed air needed to effectively operate the pump.

II. SUMMARY

The present invention is a method for increasing compressed air efficiency in a pump. More specifically, the inventive method utilizes an air efficiency device in order to minimize the amount of a compressed air in a pump. A principal object of this invention is to improve upon the teachings of the aforementioned Reynolds U.S. Pat. No. 5,257,914 and its incorporated teaching of Reynolds U.S. Pat. No. 5,332,372 by utilizing velocity and position sensing of the movement of the diaphragm assemblies to control the utilization of the pressure fluid which causes movement of the diaphragm assemblies and to do so utilizing control algorithms that accommodate changing condition influences to achieve a more optimally controlled pump. A pump is provided having diaphragm chambers and diaphragm assemblies. Each diaphragm assembly may comprise a diaphragm. An air efficiency device may allow for controlling the operation of an air operated diaphragm. A minimum and termination velocity may be defined. As one of the diaphragm chambers is filled with the compressed air, the diaphragm assembly passes a turndown position. Upon passing the turndown position, the air efficiency device stops or decreases the flow of compressed air into the pump. The air efficiency device monitors the velocity of the diaphragm assembly until it reaches its end of stroke position and redefines the turndown position if it determines that the velocity of the diaphragm assembly exceeded the defined termination velocity or fell below the defined minimum velocity. The air efficiency device then performs the same method independently for the other diaphragm assembly. Upon the other diaphragm assembly reaching its end of stroke position, the method is again repeated for the first diaphragm assembly utilizing any redefined turndown positions as appropriate.

Another object of the present invention is to provide a method for detecting an optimum turndown position of a diaphragm assembly in a pump, which may comprise the steps of:

providing a pump having a standard operating state and an air efficiency state, the pump having a first diaphragm assembly disposed in a first diaphragm chamber, the first diaphragm assembly having a first position and a second position, a current position $X_{CL}$, and a turndown position $X_{SL}$; the pump also having providing a second diaphragm assembly disposed in a second diaphragm chamber, the second diaphragm assembly having a first position, a second position, a current position $X_{CR}$, and a turndown position $X_{SR}$;

providing a linear displacement device interconnected between the first diaphragm assembly and the second diaphragm assembly, the linear displacement device having a linear displacement rod;

providing an air inlet valve in communication with the first chamber and the second chamber, said air inlet valve operated by a power source;

operating the pump in the air efficiency state, the steps comprising:

opening the air inlet valve until a sensor determines $X_{CL}>X_{SL}$ or $X_{CR}>X_{SR}$ measuring the velocity from the linear displacement rod;

evaluating operating parameters from the velocity to determine if the linear displacement rod is moving within an accepted range;

redefining $X_{SL}$, or $X_{SR}$ to reach an optimum turndown position to minimize compressed air entering into the diaphragm chambers.

Another object of the present invention is to provide a method for detecting an optimum turndown position of a diaphragm assembly in a pump, wherein the linear displacement device may comprise a housing, a linear displacement rod partially disposed in the housing, a sensor disposed within the housing, and a controller disposed within the housing.

Another object of the present invention is to provide a method for detecting an optimum turndown position of a diaphragm assembly in a pump which may further comprise the step of:

switching to the standard operational state upon failure of the power source for the air inlet valve.

Another object of the present invention is to provide a method for detecting an optimum turndown position of a diaphragm assembly in a pump which may comprise the steps of:

providing a pump having a first diaphragm assembly disposed in a first diaphragm chamber, the first diaphragm assembly having a first position and a second position, a current position $X_{CL}$ and a turndown position $X_{SL}$;

defining a minimum velocity $V_{MINL}$ and a termination velocity $V_{TERML}$;

providing an air inlet valve operatively connected to the first diaphragm chamber;

opening the air inlet valve;

filling a portion of the first diaphragm chamber with a compressed air;

moving the first diaphragm assembly towards the second diaphragm position;

decreasing air flow through the air inlet valve when $X_{CL}$ is about equal to $X_{SL}$;

monitoring the current velocity $V_{CL}$, of the first diaphragm assembly to the second diaphragm position;

redefining $X_{SL}$ if $V_{CL}<V_{MINL}$ or if $V_{CL}>V_{TERML}$ at to the second position; and, moving the first diaphragm assembly towards the first diaphragm position.

Another object of the present invention is to provide a method for detecting an optimum turndown position of a diaphragm assembly in a pump which may further comprise the steps of:

providing a second diaphragm assembly disposed in a second diaphragm chamber, the second diaphragm assembly having a first position, a second position, a current position $X_{CR}$, and a turndown position $X_{SR}$;

wherein the step of moving the first diaphragm assembly towards the first position of the first diaphragm assembly further comprises the steps of:

defining a minimum velocity $V_{MINR}$ and a termination velocity $V_{TERMIL}$;

opening the air inlet valve;

filling a portion of the second diaphragm chamber with a compressed air;

decreasing air flow through the air inlet valve when $X_{CR}$ is about equal to $X_{SR}$;

monitoring the current velocity $V_{CR}$ of the second diaphragm assembly to the second diaphragm position;

redefining $X_{SR}$ if $V_{CR}<V_{MINR}$ or if $V_{CR}>V_{TERMIL}$ at the second diaphragm position; and, moving the second diaphragm assembly towards the first position.

Another object of the present invention is to provide a method for detecting an optimum turndown position of a diaphragm assembly in a pump wherein $X_{SL}$ and $X_{SR}$ may be electronically stored independently from each other.

Another object of the present invention is to provide a method for detecting an optimum turndown position of a diaphragm assembly in a pump wherein each of the diaphragm assemblies may comprise a diaphragm, a metal plate operatively connected to the diaphragm; and a rod operatively interconnected between the metal plate of the first diaphragm assembly and the metal plate of the second diaphragm assembly.

Another object of the present invention is to provide a method for detecting an optimum turndown position of a diaphragm assembly in a pump wherein the step of redefining $X_{SL}$ if $V_{CL}<V_{MINL}$ or if $V_{CL}>V_{TERML}$ at the second diaphragm position may further comprise the step of redefining $X_{SL}$ if $V_{CL}<V_{MINL}$ or if $V_{CL}>V_{TERML}$ within about 5 mm of an end of stroke position.

Another object of the present invention is to provide a method for detecting an optimum turndown position of a diaphragm assembly in a pump wherein the step of redefining $X_{SR}$ if $V_{CR}<V_{MINR}$ or if $V_{CR}>V_{TERMIL}$ at the second diaphragm position may further comprise the step of redefining $X_{SR}$ if $V_{CR}<V_{MINR}$ or if $V_{CR}>V_{TERMIL}$ within about 5 mm of an end of stroke position.

Another object of the present invention is to provide a method for detecting an optimum turndown position of a diaphragm assembly in a pump wherein the step of monitoring the current velocity $V_{CL}$ of the first diaphragm assembly to the second position may further comprise the step of reopening the air inlet valve if a potential pump stall event is detected.

Another object of the present invention is to provide a method for detecting an optimum turndown position of a diaphragm assembly in a pump, wherein a pump stall event may occur if $V_{CL}<V_{MINL}$.

Another object of the present invention is to provide a method for detecting an optimum turndown position of a diaphragm assembly in a pump may further comprise the steps of:

redefining $X_{SL}$, such that $X_{SL}=X_{SL}+S1_L$, wherein $S1_L$ is a constant displacement value, wherein redefined $X_{SL}$ takes effect in the next stroke when the first diaphragm assembly moves from the first position to the second position.

Another object of the present invention is to provide a method for detecting an optimum turndown position of a diaphragm assembly in a pump wherein the step of redefining $X_{SL}$ if $V_{CL}<V_{MINL}$ or if $V_{CL}>V_{TERML}$ at the second position of the first diaphragm assembly may further comprise the steps of:

redefining $X_{SL}$ such that $X_{SL}=X_{SL}-S2L$ if $V_{CL}>V_{TERML}$, wherein $S2_L$ is a constant displacement value; and redefining $X_{SL}$ such that $X_{SL}=X_{SL}$ $S3_L$ if $V_{CL}<V_{MINL}$, wherein $S3_L$ is a constant displacement value.

Another object of the present invention is to provide a method for detecting an optimum turndown position of a diaphragm assembly in a pump wherein the step of decreasing air flow through the air inlet valve when $X_{CL}$ is about equal to $X_{SL}$ may further comprise the step of decreasing the air flow to zero when $X_{CL}$ is about equal to $X_{SL}$.

Another object of the present invention is to provide a method for detecting an optimum turndown position of a diaphragm assembly in a pump, the method may comprise the steps of:

providing a pump having a first diaphragm assembly disposed in a first diaphragm chamber, the first diaphragm assembly having a first diaphragm position and a second diaphragm position, a current position $X_{CL}$ and a turndown position $X_{SL}$; the pump also having providing a second diaphragm assembly disposed in a second diaphragm chamber, the second diaphragm assembly having a first diaphragm position, a second diaphragm position, a current position $X_{CR}$, and a turndown position $X_{SR}$;

defining minimum velocities $V_{MINL}$ and $V_{MINR}$ and termination velocities $V_{TERML}$ and $V_{TERMIL}$;

providing a linear displacement device operatively connected to the first diaphragm assembly and the second diaphragm assembly;

providing an air inlet valve operatively connected to the first diaphragm chamber and the second diaphragm chamber;

opening the air inlet valve;

filling a portion of the first diaphragm chamber with a compressed air;

decreasing air flow through the air inlet valve when $X_{CL}$ is about equal to $X_{SL}$;

monitoring the current velocity $V_{CL}$ of the first diaphragm assembly to the second diaphragm position;

triggering a second valve;

redefining $X_{SL}$ if $V_{CL}<V_{MINL}$ or if $V_{CL}>V_{TERML}$ at the second diaphragm position;

moving the first diaphragm assembly towards the first diaphragm position, wherein as the first diaphragm assembly moves towards the first diaphragm position, the method further comprises the steps of:

opening the air inlet valve;

filling the second diaphragm chamber with the compressed air while simultaneously exhausting the compressed air from the first diaphragm chamber;

decreasing air flow through the air inlet valve when $X_{CR}$ is about equal to $X_{SR}$;

monitoring the current velocity $V_{CR}$ of the second diaphragm assembly to the second diaphragm position;

triggering the second valve;

redefining $X_{SR}$ if $V_{CR}<V_{MINR}$ or if $V_{CR}>V_{TERMIL}$ at the second diaphragm position; and, moving the second diaphragm assembly towards the first diaphragm position, wherein $X_{SL}$ is closer to or at an optimum turn down point.

Another object of the present invention is to provide a method for detecting an optimum turndown position of a diaphragm assembly in a pump a diaphragm assembly wherein the step of triggering a second valve may be performed via an actuator pin.

Another object of the present invention is to provide a method for detecting an optimum turndown position of a diaphragm assembly in a pump wherein the steps of monitoring the current velocity $V_{CL}$ of the first diaphragm assembly to the second position and monitoring the current velocity $V_{CR}$ of the second diaphragm assembly to the second position may further comprise the steps of:

reopening the air inlet valve if a potential pump stall event is detected, wherein a pump stall event may occur if $V_{CL}<V_{MINL}$ or $V_{CR}<V_{MINR}$;

redefining $X_{SL}$, such that $X_{SL}=X_{SL}$ $S1_L$, wherein $S1_L$ is a constant displacement value, wherein redefined $X_{SL}$ takes effect in the next stroke when the first diaphragm assembly moves from the first position to the second position; and redefining $X_{SR}$, such that $X_{SR}=X_{SR}$ S1R, wherein $S1_R$ is a constant displacement value, wherein redefined $X_{SR}$ takes effect in the next stroke when the second diaphragm assembly moves from the first position to the second position.

Another object of the present invention is to provide a method for detecting an optimum turndown position of a diaphragm assembly in a pump wherein the step of redefining $X_{SL}$ if $V_{CL}<V_{MINL}$ or if $V_{CL}>V_{TERML}$ at the second position may further comprise the steps of:

redefining $X_{SL}$ such that $X_{SL}=X_{SL}-S2_L$ if $V_{CL}$, $>V_{TERML}$, wherein $S2_L$ is a constant displacement value; and redefining $X_{SL}$ such that $X_{SL}=X_{SL}+S3_L$ if $V_{CL}<V_{MINL}$, wherein $S3_L$ is a constant displacement value;

wherein the step of redefining $X_{SR}$ if $V_{MINR}>V_{CR}>V_{TERMIL}$ within about 5 mm of the second position further comprises the steps of:

redefining $X_{SR}$ such that $X_{SR}=X_{SR}-S2_R$ if $V_{CR}>V_{TERMIL}$, wherein $S2_R$ is a constant displacement value; and redefining $X_{SR}$ such that $X_{SR}=X_{SR}+S3_R$ if $V_{CR}<V_{MINR}$, wherein $S3_R$ is a constant displacement value.

Another object of the present invention is to provide a method for detecting an optimum turndown position of a diaphragm assembly in a pump, wherein the step of decreasing the air flow of the air inlet valve may comprise the step of closing the air inlet valve.

One advantage of this invention is that it is self-adjusting to provide the optimum air efficiency for operating the air operated double diaphragm pump despite changes that may occur regarding fluid pressure, inlet air pressure, or fluid viscosity.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

Figure 6A:
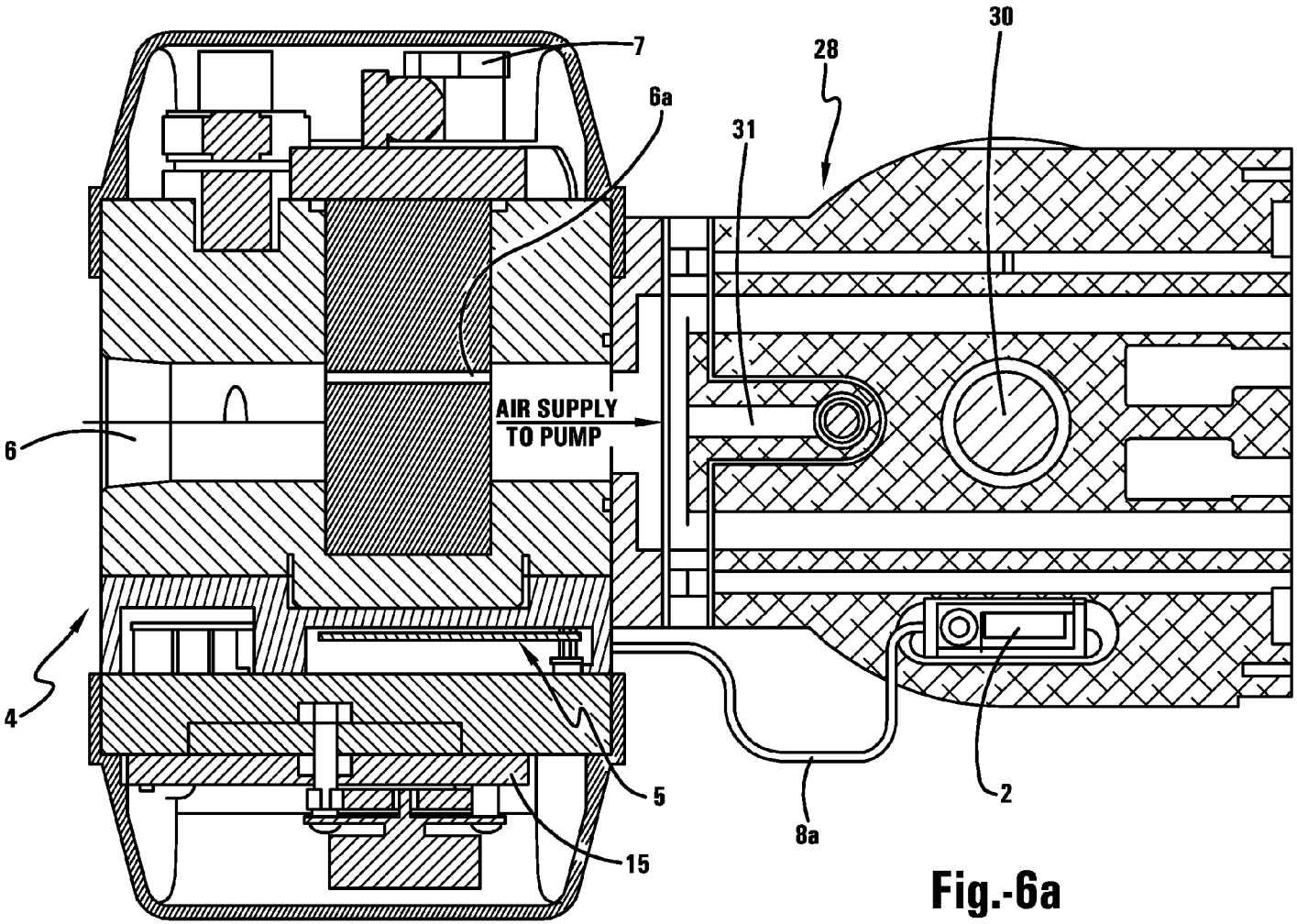
Figure 6B:
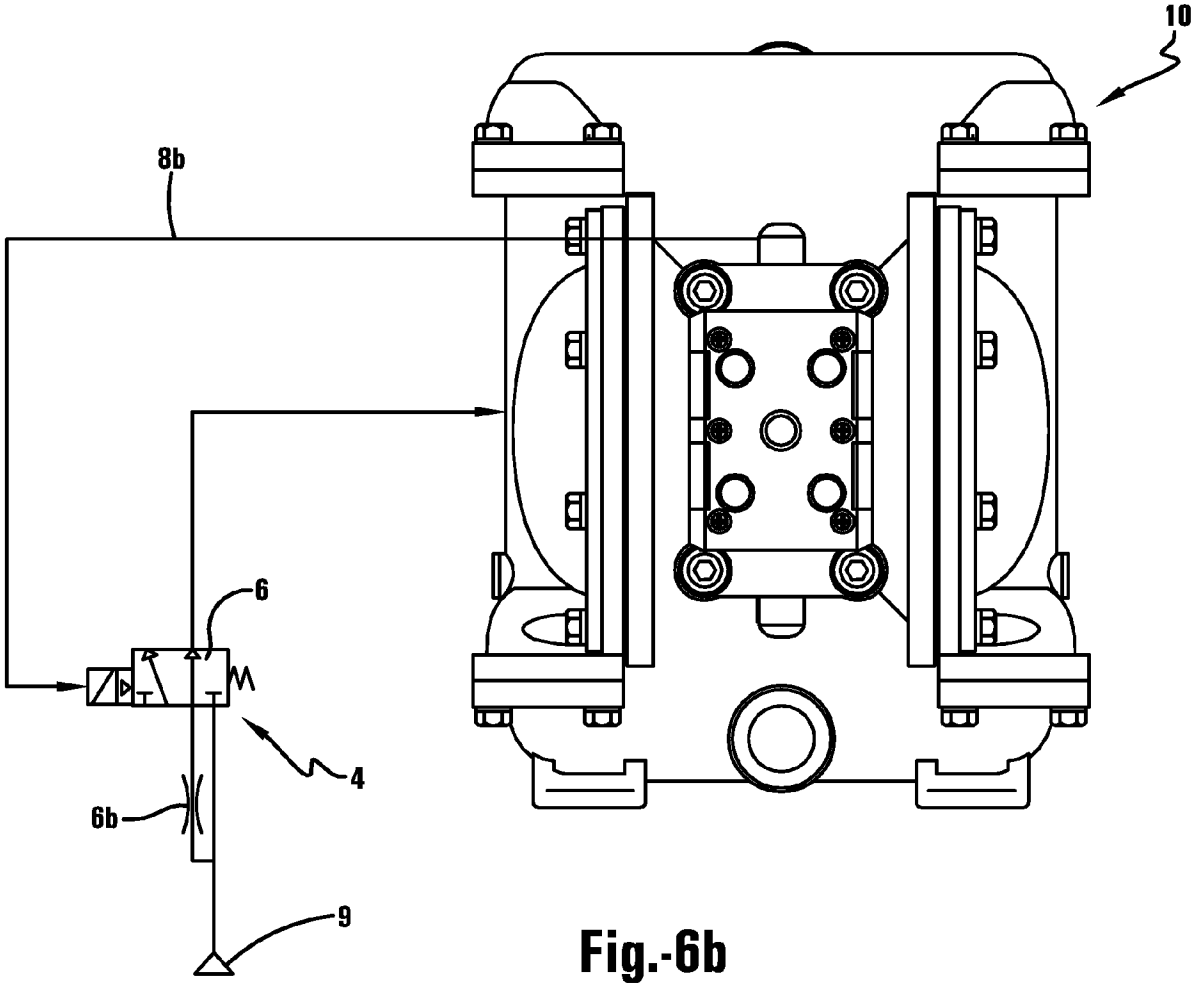
Figure 7:
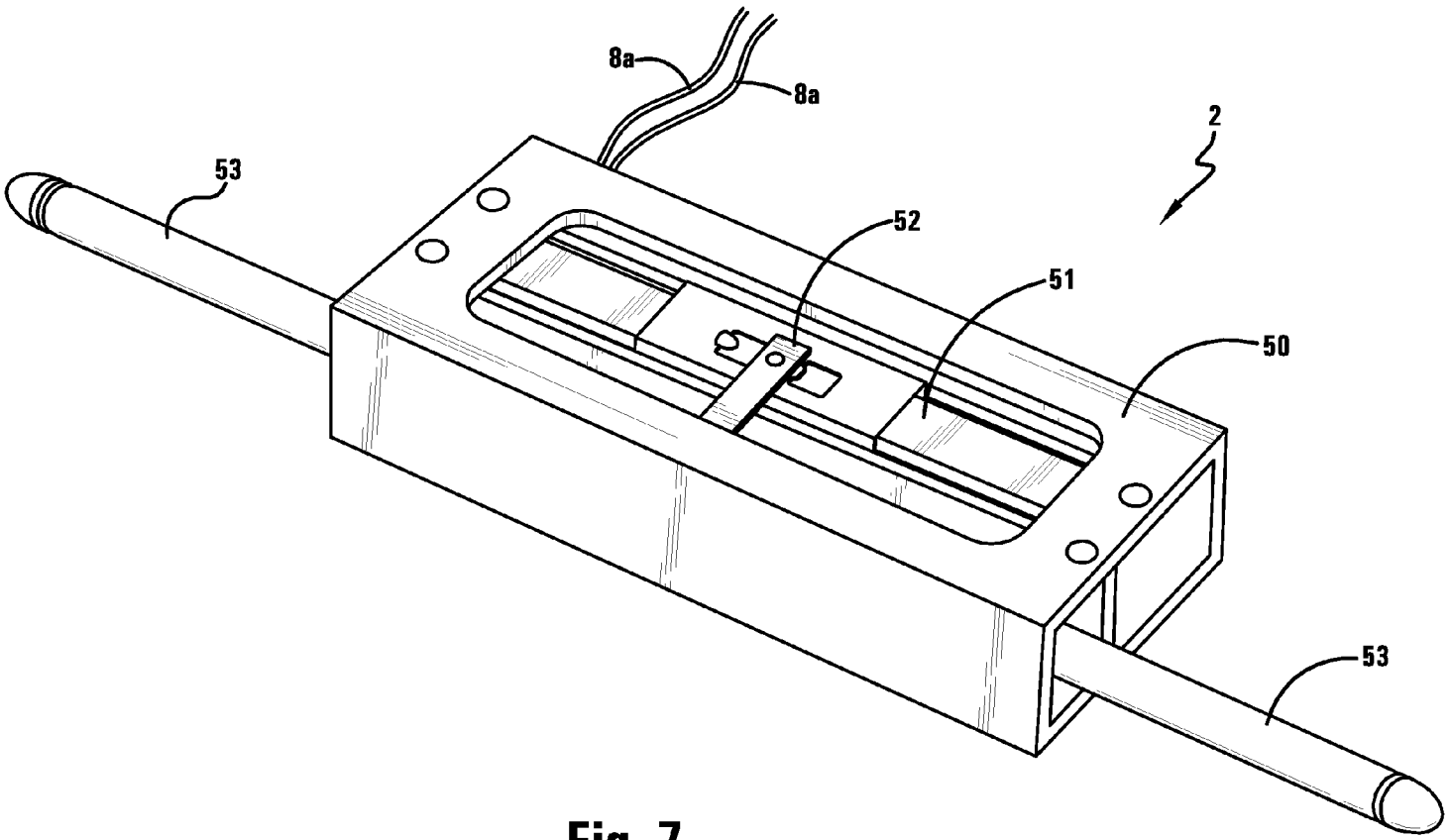
Figure 8:
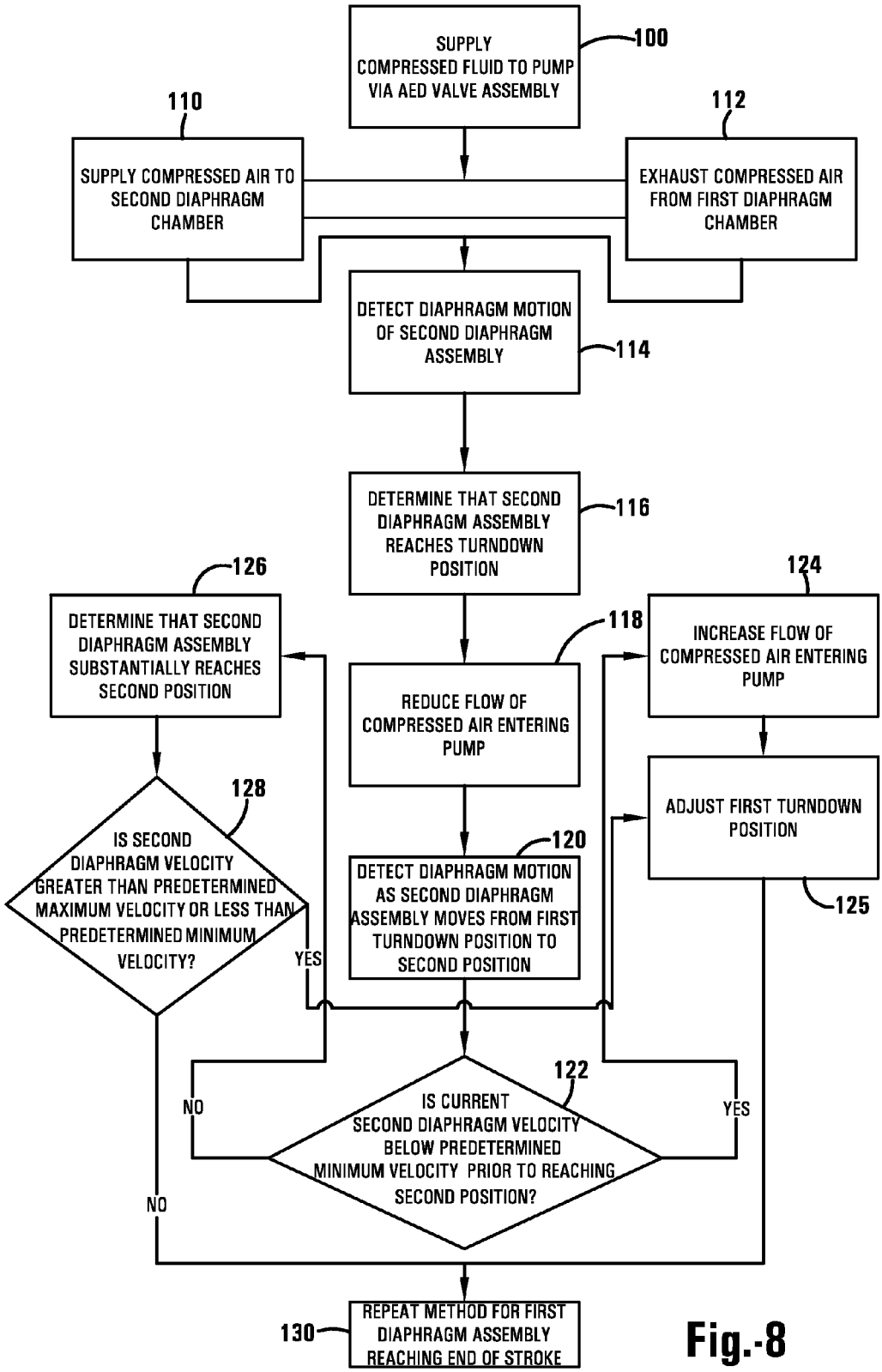

FIG. 6*a* shows a partial sectional view of an air efficiency device operatively connected to an air operated double diaphragm pump according to one embodiment of the invention;

FIG. 6*b* shows a schematic view of an air efficiency device operatively connected to an air operated double diaphragm pump according to one embodiment of the invention;

FIG. 7 shows a perspective view of a linear displacement device;

FIG. 8 shows a flow chart depicting a method for operating an air operated double diaphragm at an increased efficiency by controlling or regulating the supply of compressed fluid provided to the pump from a compressed fluid supply according to one embodiment of the invention.

IV. DETAILED DESCRIPTION

Figure 1:
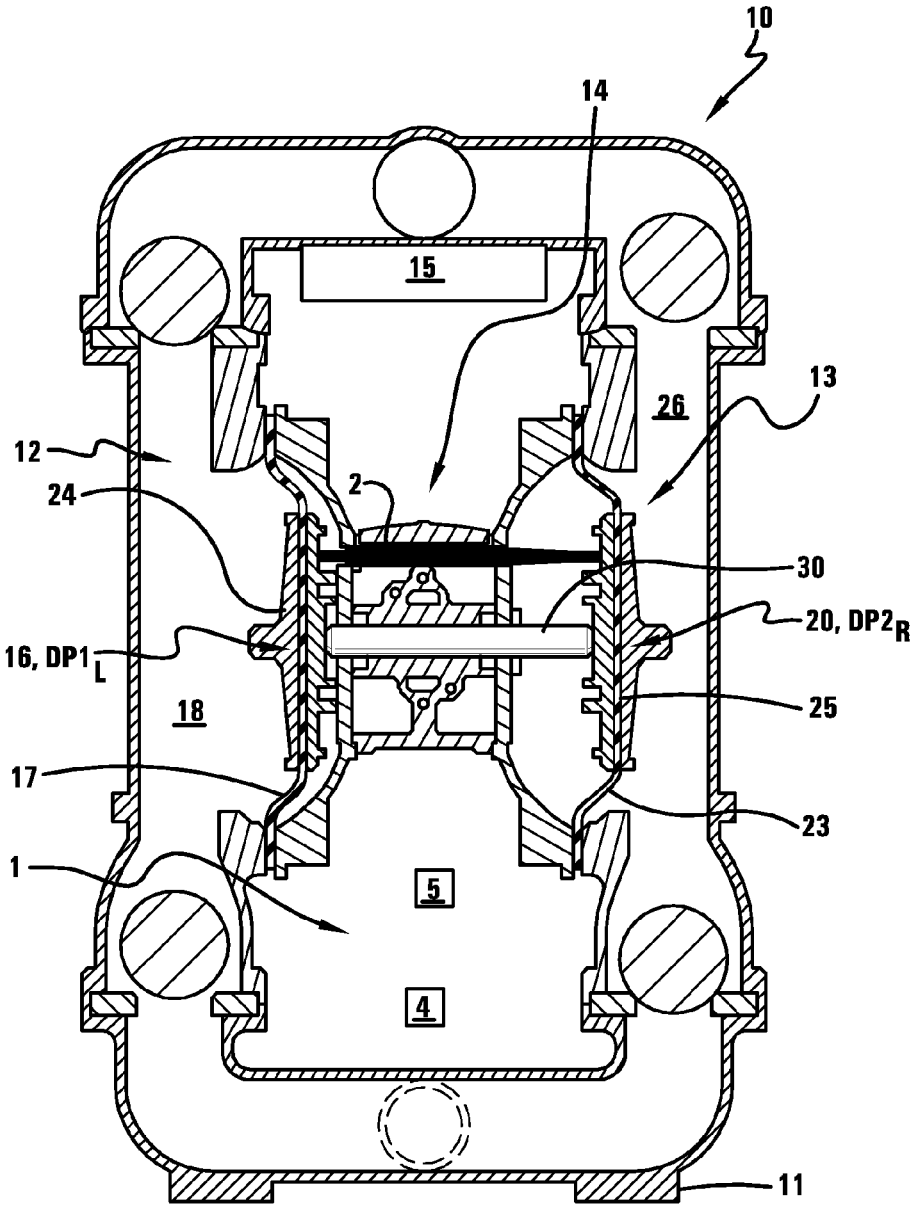
FIG. 1 shows a sectional view of an air operated double diaphragm pump according to one embodiment of the invention.

Referring now to the drawings wherein the showings are for purposes of illustrating embodiments of the invention only and not for purposes of limiting the same, FIGS. 1-8 illustrate the present invention. FIG. 1 shows an air operated double diaphragm pump 10 comprising an air efficiency device 1 according to one embodiment of the invention. The air efficiency device 1 may enable the pump 10 to operate at an increased efficiency by controlling or regulating the supply of compressed air or compressed fluid provided to the pump 10 from a compressed air or fluid supply. Hereinafter, the term "compressed air" and "compressed fluid" may be used interchangeably. The air efficiency device 1 may reduce or temporarily halt the supply of compressed air to the pump 10 beginning at a predetermined shutoff or turndown point prior to the pump's 10 end of stroke position as more fully described below. By reducing or completely halting the supply of compressed air at the turndown point, the pump 10 utilizes the natural expansion of the compressed air within the pump's chambers to reach the end of stroke position. Although the invention is described in terms of an air operated double diaphragm pump, the invention may be utilized with any type pump chosen with sound judgment by a person of ordinary skill in the art. The designations left and right are used in describing the invention for illustrative purposes only. The designations left and right are used to distinguish similar elements and positions and are not intended to limit the invention to a specific physical arrangement of the elements.

With reference now to FIG. 1, the pump 10 will generally be described. The pump 10 may comprise a housing 11, a first diaphragm chamber 12, a second diaphragm chamber 13, a center section 14, a power supply 15, and the air efficiency device 1. The first diaphragm chamber 12 may include a first diaphragm assembly 16 comprising a first diaphragm 17 and a first diaphragm plate 24. The first diaphragm 17 may be coupled to the first diaphragm plate 24 and may extend across the first diaphragm chamber 12 thereby forming a movable wall defining a first pumping chamber 18 and a first diaphragm chamber 21. The second diaphragm chamber 13 may be substantially the same as the first diaphragm chamber 12 and may include a second diaphragm assembly 20 comprising a second diaphragm 23 and a second diaphragm plate 25. The second diaphragm 23 may be coupled to the second diaphragm plate 25 and may extend across the second diaphragm chamber 13 to define a second pumping chamber 26 and a second diaphragm chamber 22. A connecting rod 30 may be operatively connected to and extend between the first and second diaphragm plates 24, 25.

Figure 2:
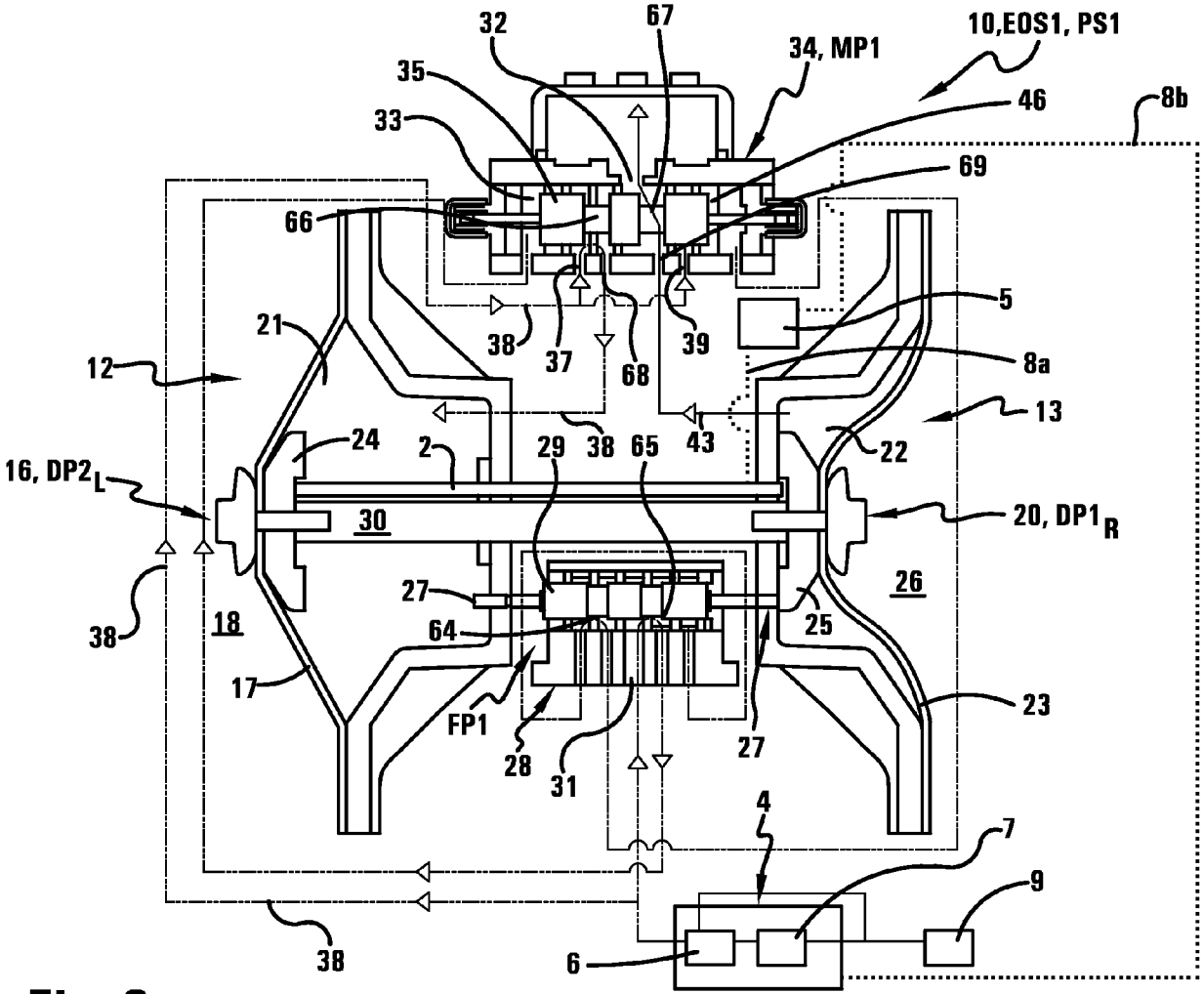
FIG. 2 shows a schematic illustration of an air operated double diaphragm pump comprising a first pump state according to one embodiment of the invention.
Figure 3:
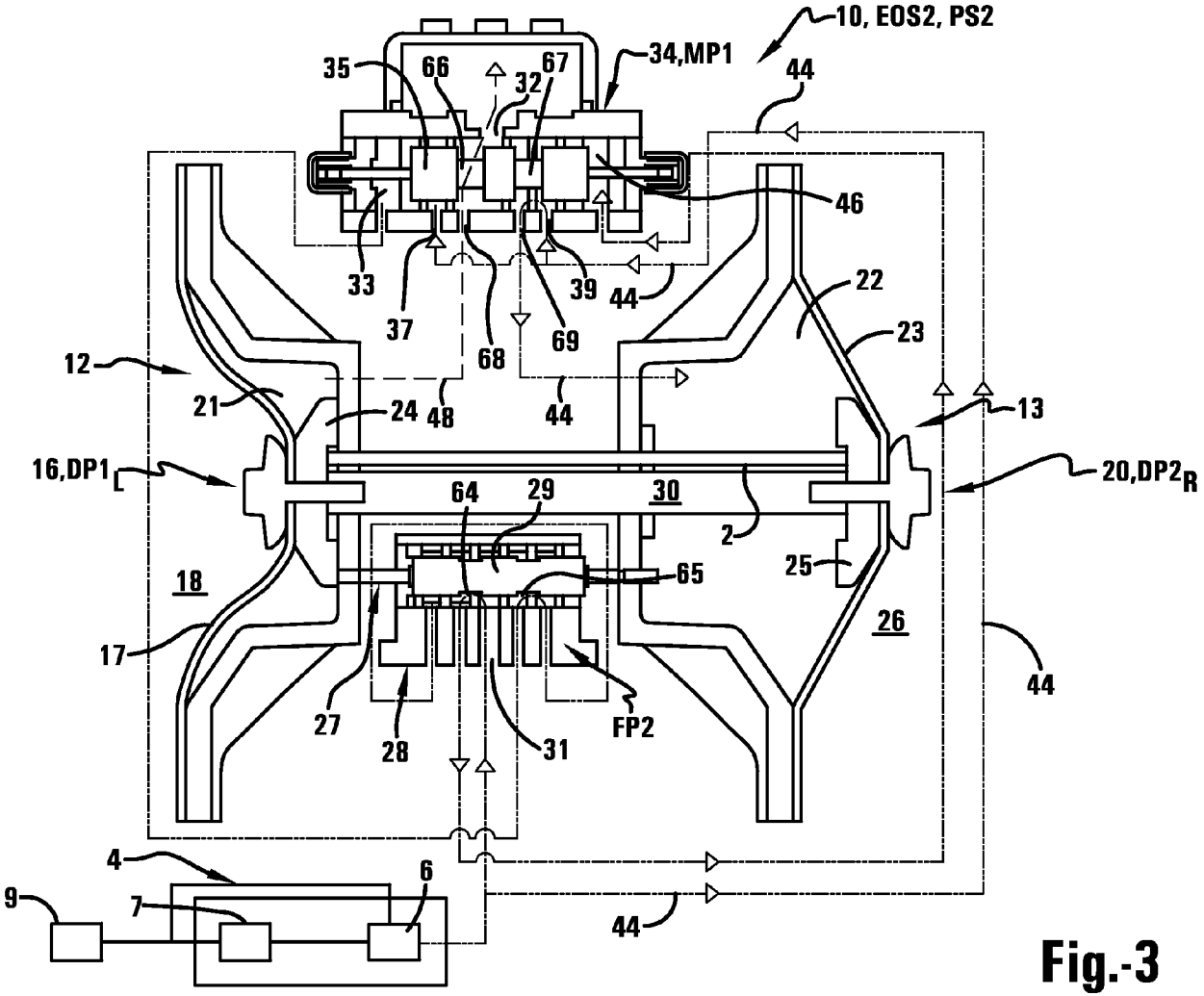
FIG. 3 shows a schematic illustration of the air operated double diaphragm pump shown in FIG. 2 comprising a second pump state according to one embodiment of the invention.
Figure 4:
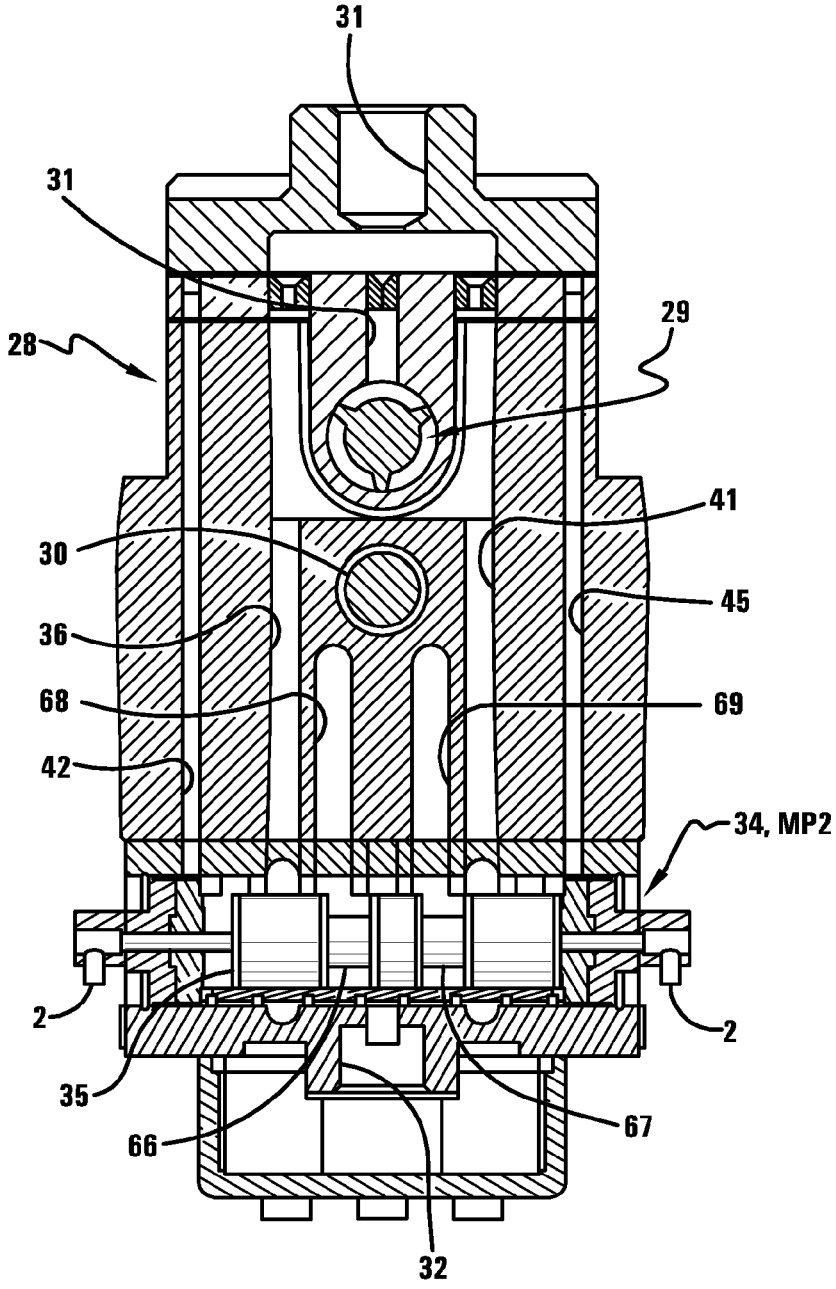
FIG. 4 shows a partial sectional view of a pilot valve assembly and a main valve assembly according to one embodiment of the invention.
Figure 5:
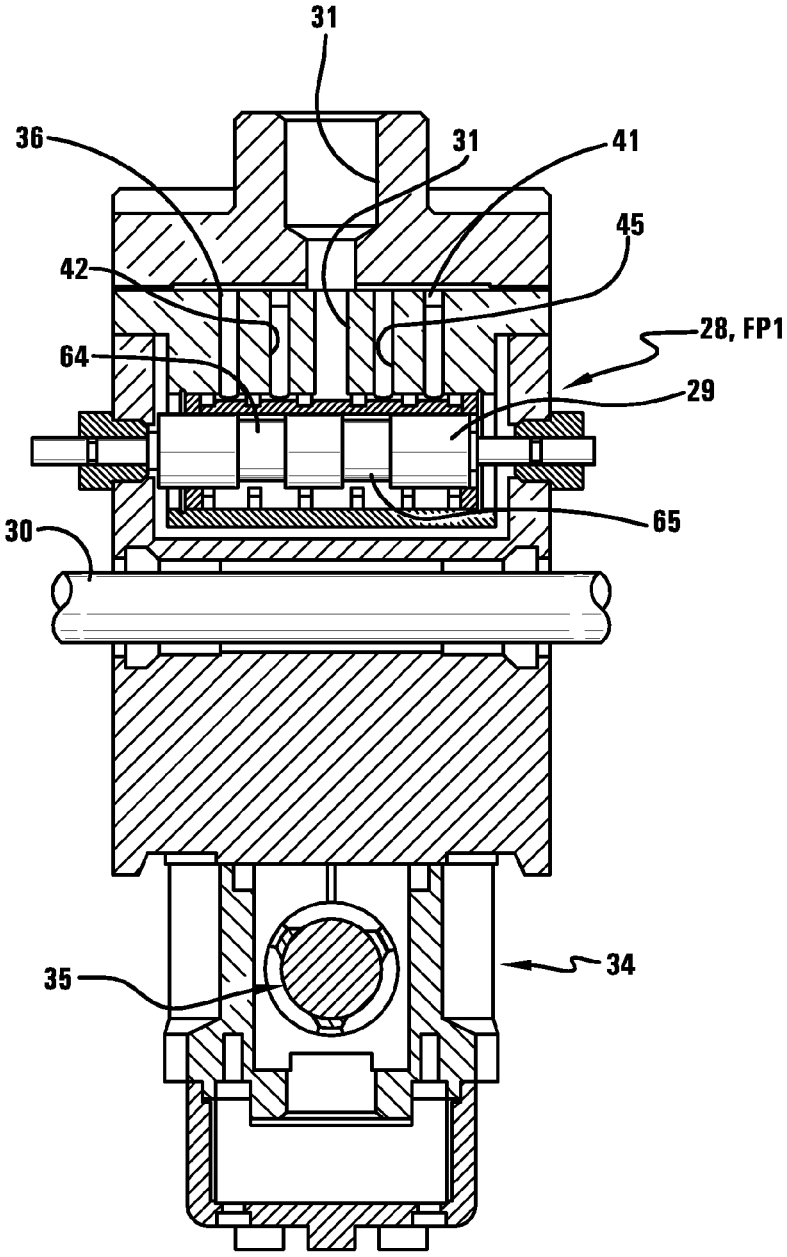
FIG. 5 shows a partial sectional view of a pilot valve assembly and a main valve assembly according to one embodiment of the invention.

With reference now to FIGS. 2 and 3, the connecting rod 30 may at least partially allow the first and second diaphragm assemblies 16, 20 to reciprocate together between a first end of stroke position EOS1, as shown in FIG. 2, and a second end of stroke position EOS2, as shown in FIG. 3. The first and second end of stroke positions EOS1, EOS2 may represent a hard-stop or physically limited position of the first and second diaphragm assemblies 16, 20, as restricted by the mechanics of the pump as is well known in the art. Next, each of the diaphragm assemblies 16, 20 within respective first and second diaphragm chambers 12, 13 may have a first diaphragm position $DP1_L$, $DP1_R$ and a second diaphragm position $DP2_L$, $DP2_R$, respectively. The first and second diaphragm positions $DP1_L$, $DP1_R$, $DP2_L$, $DP2_R$ may correspond to a predetermined and/or detected position of the first and second diaphragm assemblies 16, 20 that is reached prior to the respective end of stroke position EOS1, EOS2. In one embodiment, the first diaphragm position $DP1_L$, $DP1_R$ and the second diaphragm positions $DP2_L$, $DP2_R$ may comprise a position that is about 0.01 mm to about 10 mm from the first and second end of stroke positions EOS1, EOS2, respectively. In another embodiment, the first diaphragm position $DP1_L$, $DP1_R$ and the second diaphragm positions $DP2_L$, $DP2_R$ may comprise a position that is about 5 mm from the first and second end of stroke positions EOS1, EOS2, respectively. It is important that measurement of velocity, as described in more detail below, is never measured at the end of stroke positions, EOS1 and EOS2. Rather, velocity is measured just prior to the end of stroke positions EOS1 and EOS2.

With continued reference now to FIGS. 2 and 3, in one embodiment, the first diaphragm position $DP1_L$, $DP1_R$ may comprise a position wherein the compressed air has been substantially exhausted from the diaphragm chamber 21, 22 and a pumped fluid has been suctioned or otherwise communicated into the pumping chamber 18, 26. In the first diaphragm position $DP1_L$, $DP1_R$ the diaphragm plate 24, 25 may contact an end portion of an actuator pin 27 thereby initiating the movement of a pilot valve spool 29. The second diaphragm position $DP2_L$, $DP2_R$ may comprise a position wherein the first and second diaphragm chambers 21, 22 are substantially filled with compressed air and the pumped fluid has been substantially exhausted from the first and second pumping chambers 18, 26. In the second diaphragm position $DP2_L$, $DP2_R$ the first and second diaphragm plates 24, 25 may be positioned completely out of contact with the actuator pin 27.

With reference now to FIGS. 1-5, the center section 14 may include a pilot valve housing 28, a main fluid valve assembly 34, and the air efficiency device 1. The pilot valve housing 28 may comprise a pilot inlet 31, the actuator pin 27, a pilot valve spool 29, a first main channel 36, a second main channel 41, a first signal port channel 42, and a second signal port channel 45. The pilot valve housing 28 may at least partially allow for the control of the movement of the main fluid valve assembly 34 between a first and a second main valve position, thereby causing the compressed air to flow into either the first or second diaphragm chambers 21, 22 as more fully described below. In one embodiment, the movement of the pilot valve spool 29 may be caused by the actuator pin 27 being contacted by the first or second diaphragm plates 24, 25. The pilot inlet 31 may communicate compressed air to the first main channel 36, the second main channel 41, and the pilot valve spool 29. The pilot valve spool 29 may be movable between a first pilot position FP1, shown in FIGS. 2 and 4, and a second pilot position FP2, shown in FIG. 3. The pilot valve spool 29 may comprise a first pilot passageway 64 and a second pilot passageway 65 configured such that movement of the pilot valve spool 29 into the first pilot position FP1 allows the first pilot passageway 64 to communicate compressed air from the pilot inlet 31 to the first signal port channel 42. Further, in the first pilot position FP1, the pilot valve spool 29 may be positioned to prevent the communication of compressed air from the pilot inlet 31 to the second pilot passageway 65 and therefore the second signal port channel 45. The movement of the pilot valve spool 29 to the right or into the second pilot position FP2 may allow the second pilot passageway 65 to communicate compressed air from the pilot inlet 31 to the second signal port channel 45 while preventing the communication of compressed air to the first pilot passageway 64 and therefore the first signal port channel 42.

With continued reference to FIGS. 1-5, the main fluid valve assembly 34 may comprise a first pilot signal port 33, a second pilot signal port 46, a main fluid valve spool 35, a first inlet port 37, a second inlet port 39, a first outlet port 68, a second outlet port 69, and an exhaust port 32. The communication of compressed air to the first or second pilot signal port 33, 46 may cause the main fluid valve assembly 34 to move between a first and second main position MP1, MP2, respectively. In one embodiment, the communication of compressed air to the first pilot signal port 33 may cause the main fluid valve spool 35 to move from the first main position MP1 to the second main position MP2, shown in FIG. 3. The main fluid valve spool 35 may comprise a first main passageway 66 and a second main passageway 67. The movement of the main fluid valve spool 35 to the second main position MP2 may cause the second main passageway to be positioned to allow the communication of compressed air from the second main channel 41 through the second inlet port 39, out the second outlet port 69, and into the second diaphragm chamber 22 thereby causing the second diaphragm chamber 22 to be filled with compressed air, as illustrated by the line 44. Additionally, the first main passageway 66 of the main fluid valve spool 35 may be positioned to allow compressed air to be exhausted from the first diaphragm chamber 21 via the exhaust port 32, as illustrated by the line 48. The communication of compressed air to the second pilot signal port 46 may cause the main fluid valve spool 35 to move from the second main position MP2 to the first main position MP1 shown in FIG. 2. The movement of the main fluid valve spool 35 to the first main position MP1 may cause the first main passageway 66 to be positioned to allow the communication of compressed air from the first main channel 36 through the first inlet port 37, out the first outlet port 68, and into the first diaphragm chamber 21 thereby causing the second diaphragm chamber 22 to be filled with compressed air, as illustrated by the line 38. Additionally, the second main passageway 67 of the main fluid valve spool 35 may be positioned to allow compressed air to be exhausted from the second diaphragm chamber 22 via the exhaust port 32, as illustrated by the line 43. In another embodiment, the movement of the main valve spool 35 may be controlled electronically, for example, utilizing a solenoid and a controller, as disclosed in U.S. Pat. No. 6,036,445, which is herein incorporated by reference.

With reference now to FIGS. 1, 2, 3, 6*a*, 6*b* and 7, the air efficiency device 1 may comprise a sensor 2, a controller 5, and a valve assembly 4. The sensor 2 may comprise a contacting potentiometer or resistance sensor; an inductance sensor, such as a linear variable differential transformer (LVDT) sensor or an eddy current sensor; or, a non-contacting potentiometer displacement sensor. In one embodiment, the sensor 2 may comprise an embedded sensor sold by Sentrinsic LLC. Such sensor is described in U.S. patent application having publication number US 20070126416. In one embodiment, the sensor 2, as shown in FIG. 7, may comprise a sensor housing 50, a resistive member 51, a signal strip 52, and a sensor rod 53. The sensor housing 50 may be fixedly attached to the housing 11 and may enclose the resistive member 51, the signal strip 52, and a portion of the sensor rod 53. The sensor rod 53 may comprise an elongated, rigid structure similar to that of the conncting rod 30. The sensor rod 53 may extend through the sensor housing 50 and may be operatively connected to the first and second diaphragm assemblies 16, 20 such that the movement of the diaphragm assemblies 16, 20 causes the movement of the sensor rod 53 relative to the sensor housing 50. The resistive member 51 may comprise a variable resistant film that is fixedly coupled to the sensor housing and positioned substantially parallel to the sensor rod 53. The signal strip 52 may be fixedly attached to the sensor rod 53 such that the signal strip 52 extends substantially perpendicular relative to the resistive member 51. The signal strip 52 may extend at least partially across the resistive member 51 and may be capacitively coupled to the resistive member 51. In one embodiment, the sensor rod 53 may extend through the sensor housing 50 and may be fixedly attached at its respective ends to the first and second diaphragm plates 24, 25. The movement of the first and second diaphragm assemblies 16, 20 may cause the movement of the sensor rod 53 within the sensor housing 50 thereby causing the signal strip 52 to travel across at least a portion of the length of the resistive member 51.

With continued reference now to FIGS. 1, 2, 3, 6*a*, 6*b* and 7, the sensor 2 may be positioned to measure or detect the diaphragm motion of the first and second diaphragm assemblies 16, 20. The diaphragm motion may be defined as the motion of the respective diaphragm assemblies 16, 20 or, stated differently, the motion of the diaphragm 17, 23, the base plate 24, 25, and the connecting rod 30 moving as a single unit. The sensor 2 may continuously measure and detect the diaphragm motion as the diaphragm assemblies 16, 20 move between the first and second end of stroke positions EOS1, EOS2, i.e., over the entire stroke of the diaphragm assembly. The sensor 2 may measure or detect the diaphragm motion for the first and second diaphragm assemblies 16, 20 independently from each other as the diaphragm assembly 16, 20 moves from the second end of stroke position EOS2 to the first end of stroke position EOS1. In one embodiment, the sensor 2 may be positioned to detect the motion of the control rod 30. In another embodiment, the sensor 2 may be positioned to detect the motion of the first and second diaphragm plates 24, 25. In yet another embodiment, the air efficiency device 1 may comprise a plurality of sensors 2 wherein each sensor 2 is positioned within the housing 11 to independently detect the diaphragm motion of either the first diaphragm assembly 16 or the second diaphragm assembly 20 or a component thereof. Optionally, each of the sensors 2 may detect only a specific component of the diaphragm motion. For example, in one embodiment, a first sensor 2 may be positioned to detect the motion of the first diaphragm plate 24, a second sensor 2 may be positioned to detect the motion of the second diaphragm plate 25, and a third sensor 2 may be positioned to detect the motion of the control rod 30. U.S. Pat. No. 6,241,487, herein incorporated by reference, discloses the use of proximity sensors and an electrical interface positioned within the main fluid valve housing. U.S. Pat. No. 5,257,914, herein incorporated by reference, discloses the use of a sensor mechanism for sensing the position and rate of movement of the diaphragm assembly. The air efficiency device 1 may comprise any type and number of sensors 2 positioned to detect, measure, or sense the diaphragm motion, or a component thereof, with respect to any portion of the first or second diaphragm assemblies 16, 20 chosen with sound judgment by a person of ordinary skill in the art.

With continued reference to FIGS. 1, 2, 3, 6*a*, 6*b* and 7, the controller 5 may comprise a microprocessor or microcontroller that is operatively connected to the sensor 2 and the valve assembly 4. The controller 5 may comprise a processing unit, not shown, and an internal memory portion, not shown, and may perform calculations in accordance with the methods described herein. The controller 5 may receive and store a plurality of input signals transmitted by the sensor 2. The input signals may at least partially provide the controller 5 with information relating to the diaphragm motion of the first and second diaphragm assemblies 16, 20. The controller 5 may utilize a pre-programmed algorithm and the plurality of input signals to determine and transmit a plurality of output signals to control the operation of the valve assembly 4. The controller 5 may provide for the independent control of the valve assembly 4 such that the air efficiency device 1 optimizes the flow of compressed air into the pump 10 for each diaphragm assembly 16, 20 independently. In one embodiment, the controller 5 may comprise a 16-bit digital signal controller having a high-performance modified reduced instruction set computer (RISC) which is commercially available from a variety of suppliers known to one of ordinary skill in the art, such as but not limited to a motor control 16-bit digital signal controller having model number dsPIC30F4013-301/PT and supplied by Microchip Technology Inc. The controller 5 may be in communication with the sensor 2 and the valve assembly 4 via connections 8*a* and 8*b* respectively. In one embodiment, the connections 8*a*, 8*b* may comprise an electrically conductive wire or cable. The connections 8*a*, 8*b* may comprise any type of connection chosen with sound judgment by a person of ordinary skill in the art.

With continued reference to FIGS. 1, 2, 3, 6*a*, 6*b* and 7, the valve assembly 4 may comprise an air inlet valve 6 and an AED pilot valve 7. The valve assembly 4 may allow for the control of the flow of compressed air to the pump 10. The valve assembly 4 may be controlled by the controller 5 to allow the pump 10 to operate in a conventional mode CM, a learning mode LM, and an optimization mode OM as is more fully discussed below. The conventional mode CM may comprise the pump 10 operating in a conventional manner wherein the valve assembly 4 does not restrict the flow of compressed air into the pump 10 during the operation of the pump 10. In one embodiment, the air inlet valve 6 may comprise a normally open poppet valve and the AED pilot valve 7 may comprise a normally closed pilot valve thereby allowing the pump 10 to operate in the conventional mode CM during any period of operational failure of the air efficiency device 1. In another embodiment, the air inlet valve 6 may comprise a normally closed poppet valve and the AED pilot valve 7 may comprise a normally open pilot valve. The valve assembly 4 can comprise any type of valve assembly comprising any number and type of valves that allow for the conventional operation of the pump 10 during any period of operational failure of the air efficiency device 1 chosen with sound judgment by a person of ordinary skill in the art.

With continued reference now to FIGS. 1, 2, 3, 6*a*, 6*b*, and 7, in one embodiment, the AED pilot valve 7 may receive an output signal from the controller 5 that actuates a solenoid, not shown, in order to open the AED pilot valve 7. The opening of the AED pilot valve 7 may cause compressed air to flow from the compressed air supply 9 and into the AED pilot valve 7. The flow of compressed air into the AED pilot valve 7 may contact a stem, not shown, of the air inlet valve 6, thereby closing the air inlet valve 6. The closing of the air inlet valve 6 may prevent compressed air from entering into the pump 10. Similarly, the controller 5 may transmit, or cease transmitting, an output signal that then causes the AED pilot valve 7 to close. The closing of the AED pilot valve 7 may stop the flow of compressed air into the AED pilot valve 7 and allow the air inlet valve 6 to return to its normally open position wherein compressed air is again allowed to flow into the pump 10 to move the diaphragm assemblies 16, 20 to respective end of stroke left and end of stroke right positions.

FIGS. 6*a* and 6*b* show yet another embodiment of the present invention where the pump receives a continuous flow of compressed air. As shown in FIG. 6*a*, the air inlet valve 6 may include a leakage or bypass for allowing a reduced amount of compressed air to be continuously and/or selectively supplied to the pump 10. In one embodiment, the air inlet valve 6 may comprise a poppet valve having an air bypass 6*a* formed therein that allows the reduced amount of compressed air to be supplied to the pump 10 while the air inlet valve 6 is closed. In another embodiment shown in FIG. 6*b*, the air inlet valve 6 may comprise a 2-position valve that allows for a reduced amount of compressed air to be selectively provided to the pump 10. The 2-position valve comprises a large flow position and a reduced flow position such that the large flow position enables a less restrictive compressed air flow than the reduced flow position. In one embodiment, the air inlet valve 6 may comprise a flow restrictor 6*b*. The flow restrictor 6*b* may comprise a flow restrictor, a pressure restrictor, a variable flow restrictor, a variable pressure restrictor, or any other type of restrictor suitable for providing a reduced or restricted flow of compressed air chosen with sound judgment by a person of ordinary skill in the art. The air inlet valve 6 may comprise any type of valve chosen with sound judgment by a person of ordinary skill in the art. For example, the air inlet valve 6 may comprise a fully variable air supply valve where the degree of air flow reduction could be determined from any preset or predetermined percentage of available full flow, the initial air supply flow to a lesser percentage determined by, for example, determining the degree of velocity difference between $V_{min}$ and $V_{max}$ at $X_{SL}$ or $X_{SR}$ or at any other point chosen with sound judgment by a person of ordinary skill in the art. The pressure reduction could take place in one or more discrete steps or as a continuum from a high to a low pressure. To assure that the diaphragm assembly always has sufficient velocity to cause a pressure air reversal to occur at end of stroke where the diaphragm assembly physically actuates an end of stroke sensor, the minimum reduced pressure being supplied should not drop below the pressure necessary to cause activation of the end of stroke sensor which may, for example, be a standard pilot valve moved by contact with a portion of the valve assembly.

With continued reference to FIGS. 1, 2, 3, 6*a*, 6*b* and 7, the power supply 15 may comprise an integrated power supply attached to the pump housing 11. In one embodiment, the power supply 15 may be an integrated electric generator. The electric generator 15 may be operated by either pump inlet compressed air supply, pump exhaust, or an external power source. One advantage of the on board generator 15 is it renders the pump 10 portable. Often, the location or environment in which the pump 10 is utilized makes it impracticable to connect the pump 10 to a power outlet or stationary power source via external electrical wiring. It is also contemplated to be within the scope of the present invention that the pump 10 may be utilized in connection with a power outlet, such as a conventional wall socket, or a stationary power source via external electrical wiring.

With reference now to FIGS. 2, 3 and 8, the operation of the pump 10 will generally be described. The table below provides a partial listing and description of the reference figures used in describing the operation of the pump 10.

| Reference Figure | Description |
|---|---|
| $X_{CL}$ | Current position of the first diaphragm assembly |
| $X_{CR}$ | Current position of the second diaphragm assembly |
| $X_{SL}$ | Turndown position associated with the first diaphragm assembly |
| $X_{SR}$ | Turndown position associated with the second diaphragm assembly |
| $V_{MINL}$ | Minimum coast velocity associated with the first diaphragm assembly |
| $V_{MINR}$ | Minimum coast velocity associated with the second diaphragm assembly |
| $V_{TERML}$ | Termination velocity associated with the first diaphragm assembly determined either as an instaneous peak over a stroke or as an average of multiple velocities taken over the stroke |
| $V_{TERMIL}$ | Termination velocity associated with the second diaphragm assembly (same as other) |
| $V_{CL}$ | Current velocity of the first diaphragm assembly |
| $V_{CR}$ | Current velocity of the second diaphragm assembly |
| $S1_R$ | First constant displacement value used to redefine the first turndown position |
| $S2_R$ | Second constant displacement value used to redefine the first turndown position |
| $S3_R$ | Third constant displacement value used to redefine the first turndown position |
| $S1_L$ | Fourth constant displacement value used to redefine the second turndown position |
| $S2_L$ | Fifth constant displacement value used to redefine the second turndown position |
| $S3_L$ | Sixth constant displacement value used to redefine the second turndown position |

Generally, the pump 10 may operate by continuously transitioning between a first pump state PS1 and a second pump state PS2. The first pump state PS1, shown in FIG. 2, may comprise the pilot valve spool 29 in the first pilot position FP1; the main fluid valve spool 35 in the second main position MP2 (shown in FIG. 3); and, the first and second chambers 12, 13 in the first end of stroke position EOS1. The second pump state PS2, shown in FIG. 3, may comprise the pilot valve spool 29 in the second pilot position FP2; the main fluid valve spool 35 in the first main position MP1; and, the first and second chambers 12, 13 in the second end of stroke position EOS2. The transition of the pump 10 from the first pump state PS1 to the second pump state PS2 may begin by a compressed air supply 9 supplying compressed air through the AED valve assembly 4 to the pump 10 via the air inlet valve 6, step 100. The compressed air may flow into the pilot valve housing 28 via the pilot inlet 31. With the pilot valve spool 29 in the first pilot position FP1, a portion of the compressed air is communicated to the first pilot signal port 33 of the main fluid valve assembly 34, as illustrated by the line 40, as well as to the first and second main channels 36, 41. In one embodiment, the main fluid valve spool 35 may initially be in the first main position MP1 and the initial communication of the compressed air to the first pilot signal port 33 may cause the main fluid valve spool 35 to move from the first main position MP1 to the second main position MP2. The second main channel 41 may be in fluid communication with the second inlet port 39. In the second main position MP2, the second main passageway 67 of the main fluid valve spool 35 may allow compressed air to flow through the pilot valve housing 28 and into the second diaphragm chamber 22 as described above, step 110. Additionally, the main fluid valve spool 35 may prevent or block compressed air from being communicated through the pilot valve housing 28 to the first diaphragm chamber 21. Instead, the main fluid valve spool 35 may allow compressed air to be vented or exhausted from the first diaphragm chamber 21 through the exhaust port 32 as described above, step 112.

With continued reference to FIGS. 2, 3 and 8, the compressed air may continue to be communicated into the second diaphragm chamber 22 and exhausted from the first diaphragm chamber 21. The continued communication and exhaustion of compressed air into the second diaphragm chamber 22 and from the first diaphragm chamber 21 may cause the second diaphragm assembly 20 to move away from the first diaphragm position $DP1_R$ and towards the second diaphragm position $DP2_R$ and may cause the first diaphragm assembly 16 to move away from the second diaphragm position $DP2_L$ and towards the first diaphragm position $DP1_L$. The sensor 2 may substantially continuously measure or detect the diaphragm motion of the second diaphragm assembly 20 as the second diaphragm assembly 20 moves from the first diaphragm position $DP1_R$ to the second diaphragm position $DP2_R$, step 114. In one embodiment, the sensor 2 may substantially continuously transmit data representing the current displacement and velocity of the second diaphragm plate 25 as the second diaphragm assembly 20 moves from the first diaphragm position $DP1_R$ to the second diaphragm position $DP2_R$. The controller 5 may receive the data transmitted by the sensor 2 and may determine when the second diaphragm assembly 20, or a component thereof, reaches a first predetermined turndown position $X_{SR}$, step 116. The first turndown position $X_{SR}$ may be located between the first diaphragm position $DP1_R$ and the second diaphragm position $DP2_R$.

With continued reference to FIGS. 2, 3, and 8, in one embodiment, the first turndown position $X_{SR}$ may be determined by the pump 10 initially operating in the learning mode LM. The learning mode LM may comprise the pump 10 operating in the conventional mode CM for a predetermined number of pump strokes or pump cycles, for example, 4 pump cycles. The sensor 2 may continuously monitor the diaphragm motion of the first and/or second diaphragm assemblies 16, 20 and transmit the data to the controller 5. The controller 5 may utilize the data transmitted by the sensor 2 to determine an average velocity $V_{avg}$. The average velocity $V_{avg}$ may comprise the average velocity of the first and/or second diaphragm assemblies 16, 20 at the second diaphragm position $DP2_R$, $DP2_L$ while operating in the learning mode LM. In another embodiment, the average velocity $V_{avg}$ may comprise the average velocity of the first and/or second diaphragm assembly 16, 20 as the first and/or second diaphragm assembly 16, 20 moves between the first diaphragm position $DP1_R$, $DP1_L$ and the second diaphragm position $DP2_R$, $DP2_L$. The controller 5 may determine the average velocity $V_{avg}$ independently for the first and second diaphragm assembly 16, 20. The first turndown position $X_{SR}$ may comprise a position that is calculated to at least partially cause the velocity of the first and/or second diaphragm assembly 16, 20 at the second diaphragm position $DP2_R$, $DP2_L$ to be a predetermined percentage of the average velocity $V_{avg}$. For example, in one embodiment, the first turndown position $X_{SR}$ may comprise a position that is calculated to at least partially cause the velocity of the first and/or second diaphragm assembly 16, 20 to be about 95% of the average velocity $V_{avg}$. The controller 5 may allow for the user to selectively change the predetermined percentage of the average velocity $V_{avg}$ during the operation of the pump 10 thereby adjusting or redefining the first turndown point $X_{SR}$. In another embodiment, the first turndown position $X_{SR}$ may initially comprise an arbitrarily selected point that is dynamically refined and/or adjusted by the air efficiency device 1 to substantially reach an optimum value as described below.

With continued reference to FIGS. 2, 3 and 8, upon determining that the second diaphragm assembly 20 has reached or passed the first turndown position $X_{SR}$, the air efficiency device 1 may cause the flow of compressed air into the pump 10 to be turned down to a lower flow rate, step 118. In one embodiment, the controller 5 may cause an output signal to be transmitted to the AED pilot valve 7, which in turn may cause the air inlet valve 6 to at least partially close thereby causing the flow of compressed air into the pump 10 to decrease. In another embodiment, the AED pilot valve 7 may cause the air inlet valve 6 to partially close thereby uniformly decreasing the amount of compressed air entering into the pump 10 over a predetermined period. The sensor 2 may continue to transmit detected diaphragm motion data to the controller 5 as the second diaphragm assembly 20 continues to move from the first turndown position $X_{SR}$ to the second diaphragm position $DP2_R$, step 120. The controller 5 may receive the transmitted data from the sensor 2 and may determine if a current second diaphragm velocity $V_{CR}$ falls below a predetermined minimum coast velocity $V_{MINR}$, step 122. The minimum coast velocity $V_{MINR}$ may comprise the minimum diaphragm assembly velocity allowed after the diaphragm assembly has reached the first turndown position $X_{SR}$. If the controller 5 determines that the current second diaphragm velocity $V_{CR}$ is less than the predetermined minimum coast velocity $V_{MINR}$, the controller 5 may cause the air inlet valve 6 to open or to be turned up to provide an increased flow rate of compressed air into the pump 10, step 124. It should be understood that the minimum coast velocity $V_{MINR}$ or $V_{MINL}$ may be detected at any selected point, or continuously, to the extent the sensor 2 is able to provide feedback to the controller 5. If the minimum coast velocity $V_{MINR}$ or $V_{MINL}$ is reached at any point before end of stroke, additional compressed air will be supplied if it has been reduced. In another embodiment where the compressed air is reduced, the restrictor 6*b* will need to be adjusted to increase flow of the compressed air, and hence, result in a longer time period before diaphragm assembly reaches end of stroke. More specifically, the continuously supplied lower flow compressed air will increase enough pressure to continue to move the diaphragm assembly and will build sufficient pressure when the diaphragm assembly contacts the pilot valve, which will shift the pilot valve. Pressure will continue to increase upon any stoppage in the diaphragm assembly back to a maximum line pressure.

With continued reference to FIGS. 2, 3, and 8, in one embodiment, the controller 5 may transmit an output signal to the AED pilot valve 7 that causes the AED pilot valve 7 to close thereby allowing the air inlet valve 6 to return to its normally open position. The controller 5 may detect the potential for the pump 10 to stall and may adjust or redefine the first turndown position $X_{SR}$ to keep the air inlet valve 6 open in order to increase the amount of compress air provided to the pump 10. The controller 5 may adjust or redefine the first turndown position $X_{SR}$ by adding a first constant displacement value $S1_R$ to the first turndown position $X_{SR}$, thereby increasing the amount of time the air inlet valve 6 remains fully open, step 125. The potential for the pump 10 to stall may be detected by determining that the current second diaphragm velocity $V_{CR}$ is less than the predetermined minimum coast velocity $V_{MINR}$ before the second diaphragm assembly 20 reaches the second diaphragm position $DP2_R$. If the controller 5 determines that the current second diaphragm velocity $V_{CR}$ is less than the predetermined minimum coast velocity $V_{MINR}$ before the second diaphragm assembly 20 reaches the second diaphragm position $DP2_R$, the controller 5 may cause the diaphragm motion data received from the sensor 2 relating to that specific stroke to be discarded and not stored or saved.

With continued reference to FIGS. 2, 3, and 8, the controller 5 may next determine when the second diaphragm assembly 20 substantially reaches the second diaphragm position $DP2_R$ and may then determine the second diaphragm velocity $V_{CR}$, step 126. If the controller 5 determines that the second diaphragm velocity $V_{CR}$ is greater than a predetermined maximum termination velocity $V_{TERMIL}$ or less than the predetermined minimum coast velocity $V_{MINR}$, the controller 5 may adjust or redefine the first turndown position $X_{SR}$, step 128. The second diaphragm velocity $V_{CR}$ being greater than the predetermined maximum termination velocity $V_{TERMIL}$ as the second diaphragm assembly 20 substantially reaches the second diaphragm position $DP2_R$ indicates an opportunity to save air by utilizing a lesser amount of compressed air on the next stroke. If the controller 5 determines that the second diaphragm velocity $V_{CR}$ is greater than the predetermined maximum termination velocity $V_{TERMIL}$ as the second diaphragm assembly 20 substantially reaches the second diaphragm position $DP2_R$, thereby indicating that the second diaphragm assembly 20 is running too quickly when nearing end of stroke, the controller 5 may adjust or redefine the first turndown position $X_{SR}$ by moving the first turndown position $X_{SR}$ closer to the first diaphragm position $DP1_R$. In one embodiment, the controller 5 may redefine the first turndown position $X_{SR}$ by subtracting a second constant displacement value $S2_R$ from the first turndown position $X_{SR}$. The controller 5 may determine that the second diaphragm velocity $V_{CR}$ is less than the predetermined minimum coast velocity $V_{MINR}$ as the second diaphragm assembly 20 substantially reaches the second diaphragm position $DP2_R$ thereby indicating that the first diaphragm assembly 16 is running too slowly when nearing end of stroke. As such, the pump 10 is using very little compressed air but sacrificing significant output flow. The controller 5 may adjust or redefine the first turndown position $X_{SR}$ in order to cause a greater amount of compressed air to enter the pump 10. In one embodiment, the controller 5 may redefine the first turndown position $X_{SR}$ by adding a third constant displacement value $S3_R$ to the first turndown position $X_{SR}$. Upon passing the second diaphragm position $DP2_R$ and reaching the second end of stroke position EOS2, the second diaphragm assembly 20 may turnaround or begin moving in the opposite direction toward the first diaphragm position $DP1_R$, step 130. The controller 5 may save or store the data received from the sensor 2 as well as any redefined first turndown position $X_{SR}$.

With continued reference to FIGS. 2, 3, and 8, upon the second diaphragm assembly 20 reaching the second end of stroke position position EOS2, the pump 10 may comprise the second pump state PS2. The first diaphragm plate 24 may be in contact with the actuator pin 27 causing the pilot valve spool 29 to move to the second pilot position FP2 wherein compressed air is communicated through the pilot valve housing 28 to the second pilot signal port 46 of the main fluid valve assembly 34, as shown in FIG. 3. The continued communication of compressed air to the second pilot signal port 46 may cause the main fluid valve spool 35 to shift or move to the left, away from the second main position MP2 and into the first main position MP1, shown in FIG. 2. In the first main position MP1, the main fluid valve spool 35 of the main fluid valve 34 may thereby block or prevent the communication of compressed air through the second inlet port 39 and may position the first inlet port 37 to allow compressed air to be communicated from the first main channel 36 to the first diaphragm chamber 21 as described above. While the first diaphragm chamber 21 is being filled with compressed air, the second diaphragm chamber 22 may be vented through the exhaust port 32 of the main fluid valve assembly 34 as described above. The sensor 2 may substantially continuously monitor, measure, and/or detect the diaphragm motion of the first diaphragm assembly 16 as the first diaphragm assembly 16 moves from the first diaphragm position $DP1_L$ to the second diaphragm position $DP2_L$. The controller 5 may receive the data transmitted by the sensor 2 and may determine when the first diaphragm assembly 16, or a component thereof, reaches a second predetermined turndown position $X_{SL}$. The second turndown position $X_{SL}$ may be located between the first position $DP1_L$ and the second position $DP2_L$. The second turndown position $X_{SL}$ may be calculated while the pump 10 is operating in the learning mode LM in a similar manner as that of the first turndown position $X_{SR}$. In one embodiment, the air efficiency device 1 may utilize the same turndown position for both the first and second diaphragm assemblies 16, 20 throughout the operation of the pump 10. In other words, the first turndown position is determined on one side (left or right) and used as the reference. The other side is derived based on general symmetry of the pump. This results in an independent turndown position and a dependent turndown position. In another embodiment, the second turndown position $X_{SL}$ may initially comprise an arbitrarily selected point that is dynamically refined and/or adjusted by the air efficiency device 1 to substantially reach an optimum value.

With continued reference to FIGS. 2, 3, and 8, upon determining that the first diaphragm assembly 16 has reached or passed the second turndown position $X_{SL}$, the air efficiency device 1 may cause the flow of compressed air into the pump 10 to be turned down to a lower flow rate which may or may not be the same as the lower flow rate utilized for the second diaphragm assembly 20. The sensor 2 may continue to transmit detected diaphragm motion data to the controller 5 as the first diaphragm assembly 16 continues to move from the second turndown position $X_{SL}$ to the second diaphragm position $DP2_L$. The controller 5 may receive the transmitted data from the sensor 2 and may determine if a current first diaphragm velocity $V_{CL}$ falls below a second predetermined minimum coast velocity $V_{minL}$ before the first diaphragm assembly 16 reaches the second diaphragm position $DP2_L$. The second minimum coast velocity $V_{minL}$ may or may not comprise the same minimum diaphragm coast velocity $V_{minR}$ corresponding to the second diaphragm assembly 20. If the controller 5 determines that the current first diaphragm velocity $V_{CL}$ is less than the second predetermined minimum coast velocity $V_{minL}$ before the first diaphragm reaches the second diaphragm position $DP2_L$, the controller 5 may cause the air inlet valve 6 to open or to be turned up to an increased flow rate that may or may not be the same as the increased flow rate utilized with the second diaphragm assembly 20. The controller 5 may detect the potential for the pump 10 to stall and may adjust or redefine the second turndown position $X_{SL}$. In one embodiment, the controller 5 may redefine the second turndown position $X_{SL}$ by adding a fourth constant displacement value $S1_L$ to the second turndown position $X_{SL}$. The fourth constant displacement value $S1_L$ may or may not be the same as the first constant displacement value $S1_R$ utilized with the second diaphragm assembly 20. If the controller 5 determines that the current first diaphragm velocity $V_{CL}$ is less than the second predetermined minimum coast velocity $V_{MINL}$ before the first diaphragm assembly 16 reaches the second diaphragm position $DP2_L$, the controller 5 may cause the diaphragm motion data received from the sensor 2 relating to that specific stroke to be discarded and not stored or saved.

With continued reference to FIGS. 2, 3, and 8, the controller 5 may next determine the second diaphragm velocity $V_{CL}$ as the first diaphragm assembly 16 substantially reaches the second diaphragm position $DP2_L$. If the controller 5 determines that the first diaphragm velocity $V_{CL}$ is greater than a second predetermined maximum termination velocity $V_{TERML}$ or less than the second predetermined minimum coast velocity $V_{MINL}$, the controller 5 may redefine the second turndown position $X_{SL}$. If the controller 5 determines that the second diaphragm velocity $V_{CL}$ is greater than the second predetermined maximum termination velocity $V_{TERML}$ as the first diaphragm assembly 16 substantially reaches the second diaphragm position $DP2_L$, thereby indicating that the first diaphragm assembly 16 is running too quickly when nearing end of stroke, the controller 5 may redefine the second turndown position $X_{SL}$, by substracting a fifth constant displacement value $S2_L$ from the second turndown position $X_{SL}$. The fifth constant displacment valve $S2_L$ may or may not be the same as the second constant displacement value $S2_R$ utilized with the second diaphragm assembly 20. If the controller 5 determines that the second diaphragm velocity $V_{CL}$, is less than the second predetermined minimum coast velocity $V_{MINL}$ as the first diaphragm assembly 16 substantially reaches the second diaphragm position $DP2_L$, thereby indicating that the first diaphragm assembly 16 is running too slowly when nearing end of stroke, the controller 5 may redefine the second turndown position $X_{SL}$ by adding a sixth constant displacement value $S3_L$ to the first turndown position $X_{SL}$. Upon passing the second diaphragm position $DP2_L$ and reaching the first end of stroke position EOS1, the first diaphragm assembly 16 may turnaround or begin moving in the opposite direction toward the first diaphragm position $DP1_L$, wherein the sensor 2 monitors the diaphragm motion of the second diaphragm assembly 20 moving from the first diaphragm position $DP1_R$ to the second diaphragm position $DP2_R$ and the method repeats itself utilizing any redefined values of $X_{SR}$ as necessary.

The controller 5 may save or store the data received from the sensor 2 as well as any redefined turndown positions $X_{SR}$, $X_{SL}$ for the diaphragm motion of the first and second diaphragm assemblies 16, 20. The data stored relating to the diaphragm motion of the second diaphragm assembly 20 may be stored separately from the data relating to the diaphragm motion of the first diaphragm assembly 16. In another embodiment, the air efficiency device 1 may utilize a single turndown position for both the first and second diaphragm assemblies 16, 20 such that the first turndown position $X_{SR}$, and any adjustments made thereto, is utilized as the second turndown position $X_{SL}$, and any adjustments then made to the second turndown position $X_{SL}$, subsequently comprises the first turndown position $X_{SR}$ such that the turndown position is dynamically adjusted to optimize the flow of compressed air into the pump 10. In one embodiment, the second turndown position is dependent of the first turndown position, wherein the second turndown position may be determined by the symmetry of the pump 10. The controller 5 may utilize the same or different predetermined values for any or all of the predetermined values utilized to adjust or optimize the diaphragm motion of the first and second diaphragm assemblies 16, 20. The predetermined values may be dependent upon the type of pump and the material to be pumped by the pump 10. Additionally, the predetermined values may be may be specific to the pump 10. The predetermined values can be determined by a person of ordinary skill in the art without undue experimentation. In one embodiment, the air efficiency device 1 may comprise an output device, not shown, that allows the user to download or otherwise access the data relating to the diaphragm motion of the first and second diaphragm assemblies 16, 20. Additionally, the air efficiency device 1 may comprise an input device, not shown, that allows the user to define or change the predetermined values, for example the first turndown point $X_{SR}$ or the predetermined percentage of time the air inlet valve is open.

While operating in the optimization mode OM, the controller 5 may cause the pump 10 to periodically operate in the learning mode LM in order to re-define the first and/or second turndown positions $X_{SR}$, $X_{SL}$. In one embodiment, the controller 5 may cause the pump 10 to periodically operate in the learning mode LM after the pump 10 operates for a predetermined number of strokes or cycles in the optimization mode OM. In another embodiment, the controller 5 may cause the pump 10 to re-enter the learning mode LM upon determining that the velocity of the first and/or second diaphragm assemblies 16, 20 at the second diaphragm position $DP2_R$, $DP2_L$ is outside of a predetermined range of velocities. Optionally, the air efficiency device 1 may allow the user to selectively cause the pump 10 to operate in the learning mode LM.

In summary, the air efficiency device 1 monitors the diaphragm motion of the pump 10 as the first and second diaphragm assemblies transition between the two end of stroke positions in order to optimize the amount of compressed air supplied to the pump 10. The air efficiency device 1 may substantially continuously monitor the velocity of one of the diaphragm assemblies 16, 20 of the pump 10 to determine the current position of the diaphragm assembly as the diaphragm assembly travels between a first and second diaphragm positions. Upon determining that the diaphragm assembly has reached a predetermined position, the air efficiency device 1 may cause the supply or flow rate of compressed air to be reduced while the diaphragm assembly continues to move to the second diaphragm position. The air efficiency device 1 continues to monitor the diaphragm motion of the diaphragm assembly until the diaphragm assembly reaches the second diaphragm position. If the air efficiency device determines that the velocity of the diaphragm assembly falls below a predetermined minimum velocity prior to the diaphragm assembly reaching the second diaphragm position, the supply or flow rate of compressed air to the pump is increased and the predetermined position is redefined as described above. If the air efficiency device determines that the velocity of the diaphragm assembly is either greater than a predetermined termination velocity or less than the predetermined minimum velocity the predetermined position is redefined. The diaphragm assembly then reaches end of stroke and the air efficiency device 1 monitors the diaphragm motion of the other diaphragm assembly as the diaphragm assemblies move in the opposite direction and similarly redefines a second predetermined position as described above. In one embodiment, subsequent monitoring of either diaphragm assembly by the air efficiency device 1 may utilize any redefined positions previously determined for that specific diaphragm assembly. In another embodiment, the subsequent monitoring of either diaphragm assembly by the air efficiency device 1 may utilized any redefined positions previously determined for the opposite diaphragm assembly. By utilizing the inventive method described herein, the pump self adjusts to determine the optimum turndown point so as to provide for air savings, and thus energy savings.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A method comprising the steps of:

providing a pump having a first diaphragm assembly disposed in a first diaphragm chamber, the first diaphragm assembly having a first end-of-stroke position ($DP1_L$) and a second end-of-stroke position ($DP2_L$), a first current position($X_{CL}$) and a first turndown position ($X_{SL}$);

defining a first minimum velocity ($V_{MINL}$) and a first termination velocity ($V_{TERML}$);

providing an air inlet valve operatively connected to the first diaphragm chamber;

opening the air inlet valve;

filling a portion of the first diaphragm chamber with a compressed air;

decreasing air flow through the air inlet valve when the first current position ($X_{CL}$) meets the first turndown position ($X_{SL}$);

monitoring a first current velocity ($V_{CL}$) of the first diaphragm assembly while it is translated toward the second end-of-stroke position ($DP2_L$);

redefining the first turndown position ($X_{SL}$) if the first current velocity ($V_{CL}$) at the second end-of-stroke position ($DP2_L$) is one of:

less than the first minimum velocity($V_{MINL}$); or greater than the first termination velocity ($V_{TERML}$); and, translating the first diaphragm assembly toward the first end-of-stroke position ($DP1_L$).

2. The method of claim 1, further comprising the steps of:

providing a second diaphragm assembly disposed in a second diaphragm chamber, the second diaphragm assembly having a third end-of-stroke position ($DP1_R$), a fourth end-of-stroke position ($DP2_R$), a second current position ($X_{CR}$) and a second turndown position ($X_{SR}$);

wherein the step of translating the first diaphragm assembly toward the first end-of-stroke position ($DP1_L$) further comprises the steps of:

defining a second minimum ($V_{MINR}$) and a second termination velocity ($V_{TERMIL}$);

opening the air inlet valve;

filling a portion of the second diaphragm chamber with a compressed air;

decreasing air flow through the air inlet valve when the second current position ($X_{CR}$) meets the second turndown position ($X_{SR}$);

monitoring a second current velocity ($V_{CR}$) of the second diaphragm assembly while it is translated to the fourth end-of-stroke position ($DP2_R$);

redefining the second turndown position ($X_{SR}$) if the second current velocity ($V_{CR}$) at the fourth diaphragm end-of-stroke position ($DP2_R$) is one of:

less than the second minimum velocity ($V_{MINR}$); or greater than the second termination velocity ($V_{TERMIL}$); and, translating the second diaphragm assembly toward the third end-of-stroke position ($DP1_R$).

3. The method of claim 2, wherein the first turndown position ($X_{SL}$) and the second turndown position ($X_{SR}$) are electronically stored independently from each other.

4. The method of claim 1, wherein said first diaphragm assembly comprises:

a diaphragm; and a metal plate operatively connected to the diaphragm, wherein a rod is operatively connected to the metal plate.

5. The method of claim 2, wherein the second diaphragm assembly comprises:

a diaphragm; and a metal plate operatively connected to the diaphragm; wherein a rod is operatively interconnected between a metal plate of the first diaphragm assembly and the metal plate of the second diaphragm assembly.

6. The method of claim 1, wherein the step of monitoring the first current velocity ($V_{CL}$,) of the first diaphragm assembly while it is translated toward the second end-of-stroke position ($DP2_L$) further comprises the step of:

increasing air flow through the air inlet valve if a potential pump stall event is detected.

7. The method of claim 6, wherein the pump stall event may occur if the first current velocity ($V_{CL}$) is less than the first minimum velocity ($V_{MINL}$).

8. The method of claim 6, further comprising the steps of:

redefining the first turndown position ($X_{SL}$), such that a first redefined first turndown position ($X_{SL1}$) is equal to a sum of the first turndown position ($X_{SL}$) and a first constant displacement value ($S_{1L}$), wherein the first redefined first turndown position ($X_{SL1}$) takes effect in a next stroke when the first diaphragm assembly is translated from the first end-of-stroke position ($DP1_L$) toward the second end-of-stroke position ($DP2_L$).

9. The method of claim 1, wherein the step of redefining the first turndown position ($X_{SL}$) further comprises the steps of:

redefining the first turndown position ($X_{SL}$) such that a second redefined first turndown position ($X_{SL2}$) is equal to the first turndown position ($X_{SL}$) minus a second constant displacement value ($S_{2L}$), if the first current velocity ($V_{CL}$) is greater than the first termination velocity ($V_{TERML}$); and redefining the first turndown position ($X_{SL}$) such that the second redefined first turndown position ($X_{SL2}$) is equal to a sum of the first turndown position ($X_{SL}$) and a third constant displacement value ($S_{3L}$), if the first current velocity ($V_{CL}$) is less than the first minimum velocity ($V_{MINL}$).

10. The method of claim 1, wherein the step of decreasing air flow through the air inlet valve when the first current position ($X_{CL}$) meets the first turndown position ($X_{SL}$) further comprises the step of:

closing the air inlet valve.

11. The method of claim 1, wherein the first termination velocity ($V_{TERML}$) is calculated using average velocities over a stroke.

12. A method for detecting an optimum turndown position of a diaphragm assembly in a pump, the method comprising the steps of:

providing a pump comprising a first diaphragm assembly disposed in a first diaphragm chamber, the first diaphragm assembly comprising a first end-of-stroke position ($DP1_L$) and a second end-of-stroke position ($DP2_L$), a first current position ($X_{CL}$) and a first turndown position ($X_{SL}$); the pump further comprising a second diaphragm assembly disposed in a second diaphragm chamber, the second diaphragm assembly comprising a third end-of-stroke position ($DP1_R$), a fourth end-of-stroke position ($DP2_R$), a second current position ($X_{CR}$), and a second turndown position ($X_{SR}$);

defining a first minimum velocity ($V_{MINL}$), a second minimum velocity ($V_{MINR}$), a first termination velocity ($V_{TERML}$), and a second termination velocity ($V_{TERMIL}$);

providing a sensor operatively connected to the first diaphragm assembly and the second diaphragm assembly;

providing a first air inlet valve operatively connected to the first diaphragm chamber and the second diaphragm chamber;

opening the first air inlet valve;

filling a portion of the first diaphragm chamber with a compressed air;

decreasing air flow through the first air inlet valve when the first current position ($X_{CL}$) meets the first turndown position ($X_{SL}$);

monitoring a first current velocity ($V_{CL}$) of the first diaphragm assembly while it is translated to the second end of-stroke position ($DP2_L$);

redefining the first turndown position ($X_{SL}$) if the first current velocity ($V_{CL}$) at the second end-of-stroke position ($DP2_L$) is one of:

less than the first minimum velocity($V_{MINL}$); or greater than the first termination velocity ($V_{TERML}$);

translating the first diaphragm assembly towards the first end-of-stroke position ($DP1_L$), wherein upon the first diaphragm assembly translating towards the first end-of-stroke position ($DP1_L$), the method further comprises the steps of:

increasing air flow through the first air inlet valve;

filling the second diaphragm chamber with the compressed air while exhausting the compressed air from the first diaphragm chamber; and decreasing air flow through the first air inlet valve when the second current position ($X_{CR}$) meets the second turndown position ($X_{SR}$);

monitoring a second current velocity ($V_{CR}$) of the second diaphragm assembly while it is translated to the fourth end-of-stroke position ($DP2_R$);

redefining the second turndown position ($X_{SR}$) if the second current velocity ($V_{CR}$) at the fourth end-of-stroke position ($DP2_R$) is one of:

less than the second minimum velocity($V_{MINR}$); or greater than the second termination velocity ($V_{TERMIL}$); and translating the second diaphragm assembly towards the third end-of-stroke position ($DP1_R$), wherein a first redefined first turndown position ($X_{SL1}$) is closer to an optimum turn down point than the first turndown position ($X_{SL}$).

13. The method of claim 12, wherein the first turndown position ($X_{SL}$) and the second turndown position ($X_{SR}$) are electronically stored independently from each other.

14. The method of claim 12, wherein after the step of monitoring the first current velocity ($V_{CL}$) of the first diaphragm assembly while it is translated to the second end-of-stroke position ($DP2_1$), the method further comprises the step of:

triggering a second air inlet valve, wherein the second air inlet valve is triggered using an actuator pin.

15. The method of claim 12, wherein the steps of monitoring the first current velocity ($V_{CL}$) of the first diaphragm assembly while it is translated to the second end-of-stroke position ($DP2_L$) and monitoring the second current velocity ($V_{CR}$) of the second diaphragm assembly while it is translated to the fourth end-of-stroke position ($DP2_R$) further comprise the steps of:

increasing air flow through the first air inlet valve if a potential pump stall event is detected, wherein a pump stall event is detected if one or more of:

the first current velocity ($V_{CL}$) is less than the first minimum velocity ($V_{MINL}$); and the second current velocity ($V_{CR}$) is less than the second minimum velocity ($V_{MINR}$);

redefining the first turndown position ($X_{SL}$), such that the first redefined first turndown position ($X_{SL1}$) is equal to a sum of the first turndown position ($X_{SL}$) and a first constant displacement value ($S_{1L}$), wherein the redefined first turndown position ($X_{SL1}$) takes effect in a next stroke when the first diaphragm assembly translates from the first end-of-stroke position ($DP1_L$) to the second end-of-stroke position ($DP2_L$); and, redefining the second turndown position ($X_{SR}$), such that a first redefined second turndown position ($X_{SR1}$) is equal to a sum of the second turndown position ($X_{SR}$) and a second constant displacement value ($S_{1R}$), wherein the first redefined second turndown position ($X_{SR1}$) takes effect in a next stroke when the second diaphragm assembly translates from the third end-of-stroke position ($DP1_R$) to the fourth end-of-stroke position ($DP2_R$).

16. The method of claim 12, wherein one or more of:

the step of redefining the first turndown position ($X_{SL}$) further comprises the steps of:

redefining the first turndown position ($X_{SL}$) such that a second redefined first turndown position ($X_{SL2}$) is equal to the first turndown position ($X_{SL}$) minus a third constant displacement value ($S_{2L}$), if the first current velocity ($V_{CL}$) is greater than the first termination velocity ($V_{CL}$); and redefining the first turndown position ($X_{SL}$) such that a third redefined first turndown position ($X_{SL3}$) is equal to a sum of the first turndown position ($X_{SL}$) and a fourth constant displacement value ($S_{3L}$), if the first current velocity ($V_{CL}$) is less than the first minimum velocity ($V_{MINL}$); and the step of redefining the second turndown position ($X_{SR}$) further comprises the steps of:

redefining the second turndown position ($X_{SR}$) such that a second redefined second turndown position ($X_{SR2}$) is equal to the second turndown position ($X_{SR}$) minus a fifth constant displacement value ($S_{2R}$), if the second current velocity ($V_{CR}$) is greater than the second termination velocity ($V_{TERMIL}$); and redefining the second turndown position ($X_{SR}$) such that a third redefined second turndown position ($X_{SR3}$) is equal to a sum of the second turndown position ($X_{SR}$) and a sixth constant displacement value ($S_{3R}$), if the second current velocity ($V_{CR}$) is less than the second minimum velocity ($V_{MINR}$).

17. The method of claim 12, wherein the step of decreasing the air flow of the first air inlet valve comprises the step of:

closing the first air inlet valve.

18. A method for detecting an optimum turndown position of a diaphragm assembly in a pump, comprising the steps of:

providing a pump comprising a conventional mode and an optimization mode, the pump comprising a first diaphragm assembly disposed in a first diaphragm chamber, the first diaphragm assembly comprising a first end-of-stroke position ($DP1_L$) and a second end-of-stroke position ($DP2_L$), a first current position ($X_{CL}$) and a first turndown position ($X_{SL}$); the pump further comprising a second diaphragm assembly disposed in a second diaphragm chamber, the second diaphragm assembly comprising a third end-of-stroke position ($DP1_R$), a fourth end-of-stroke position ($DP2_R$), a second current position ($X_{CR}$), and a second turndown position ($X_{SR}$);

providing an air efficiency device operatively coupled to the first diaphragm assembly and the second diaphragm assembly;

providing an air inlet valve in communication with the first chamber and the second chamber, said air inlet valve operated by a power source; and operating the pump in the optimization mode, the steps comprising:

opening the air inlet valve until the sensor determines the first current position ($X_{CL}$) meets the first turndown position ($X_{SL}$) the second current position ($X_{CR}$) meets the second turndown position ($X_{SR}$);

determining a diaphragm motion of the first diaphragm assembly or the second diaphragm assembly;

evaluating operating parameters from the diaphragm motion to determine if the first diaphragm assembly or the second diaphragm assembly is moving within an accepted range; and redefining one or more of the first turndown position ($X_{SL}$) and the second turndown position ($X_{SR}$) such that one or more of the first turndown position ($X_{SL}$) and the second turndown position ($X_{SR}$) approach an optimum turndown position.

19. The method of claim 18, wherein the air efficiency device comprises:

a sensor, wherein the sensor is operatively coupled to the first diaphragm assembly and the second diaphragm assembly;

a valve assembly, wherein the valve assembly controls the opening or closing of the air inlet valve; and, a controller, wherein the controller is operatively coupled to the sensor and the valve assembly.

20. The method of claim 18, further comprising the step of:

switching to the conventional mode upon failure of the power source for the air inlet valve.

21. The method of claim 18, wherein upon a redefined first turndown position ($X_{SL1}$) meeting the optimum turndown position, the method further comprises calculating a redefined second turndown position ($X_{SR}$) using the redefined first turndown position based at least upon pump symmetry.

* * * * *